US008239191B2

(12) United States Patent
Ehara et al.

(10) Patent No.: US 8,239,191 B2
(45) Date of Patent: Aug. 7, 2012

(54) SPEECH ENCODING APPARATUS AND SPEECH ENCODING METHOD

(75) Inventors: Hiroyuki Ehara, Kanagawa (JP); Toshiyuki Morii, Kanagawa (JP); Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 704 days.

(21) Appl. No.: 12/440,661

(22) PCT Filed: Sep. 14, 2007

(86) PCT No.: PCT/JP2007/067960

§ 371 (c)(1),
(2), (4) Date: Mar. 10, 2009

(87) PCT Pub. No.: WO2008/032828

PCT Pub. Date: Mar. 20, 2008

(65) Prior Publication Data

US 2009/0265167 A1 Oct. 22, 2009

(30) Foreign Application Priority Data

Sep. 15, 2006 (JP) ..... 2006-251532
Mar. 1, 2007 (JP) ..... 2007-051486
Aug. 22, 2007 (JP) ..... 2007-216246

(51) Int. Cl.
*G10L 19/00* (2006.01)
*G10L 21/02* (2006.01)

(52) U.S. Cl. ..... 704/219; 704/200.1; 704/226

(58) Field of Classification Search ..... None
See application file for complete search history.

(56) References Cited

U.S. PATENT DOCUMENTS 5,341,456 A * 8/1994 DeJaco ..... 704/214
5,774,835 A * 6/1998 Ozawa ..... 704/205
5,787,390 A 7/1998 Quinquis et al.
(Continued)

FOREIGN PATENT DOCUMENTS

JP 7-086952 A 3/1995
(Continued)

OTHER PUBLICATIONS

Acero et al., "Environmental Robustness in Automatic Speech Recognition", International Conference on Acoustics, Speech, and Signal Processing, ICASSP-90, pp. 849-852, vol. 2, Apr. 1990.*
(Continued)

*Primary Examiner* — Brian Albertalli
(74) *Attorney, Agent, or Firm* — Greenblum & Bernstein, P.L.C.

(57) ABSTRACT

Disclosed is an audio encoding device capable of adjusting a spectrum inclination of a quantized noise without changing the Formant weight. The device includes: an HPF (131) which extracts a high-frequency component of the frequency region from an input audio signal; a high-frequency energy level calculation unit (132) which calculates an energy level of the high-frequency component in a frame unit; an LPF (133) which extracts a low-frequency component of the frequency region from the input audio signal; a low-energy level calculation unit (134) which calculates an energy level of a low-frequency component in a frame unit; an inclination correction coefficient calculation unit (141) multiplies the difference between SNR of the high-frequency component and SNR of the low-frequency component inputted from an adder (140) by a constant and adds a bias component to the product so as to calculate an inclination correction coefficient ?3. The inclination correction coefficient is used for adjusting the spectrum inclination of a quantized noise.

15 Claims, 22 Drawing Sheets

U.S. PATENT DOCUMENTS

| | | | | |
|---|---|---|---|---|
| 6,006,177 | A | 12/1999 | Funaki | |
| 6,064,962 | A * | 5/2000 | Oshikiri et al. | 704/262 |
| 6,385,573 | B1 * | 5/2002 | Gao et al. | 704/220 |
| 6,615,169 | B1 * | 9/2003 | Ojala et al. | 704/205 |
| 6,799,160 | B2 | 9/2004 | Yasunaga et al. | |
| 6,941,263 | B2 * | 9/2005 | Wang et al. | 704/219 |
| 7,024,356 | B2 | 4/2006 | Yasunaga et al. | |
| 7,043,030 | B1 | 5/2006 | Furuta | |
| 7,289,953 | B2 | 10/2007 | Yasunaga et al. | |
| 7,379,866 | B2 * | 5/2008 | Gao | 704/220 |
| 7,383,176 | B2 | 6/2008 | Yasunaga et al. | |
| 8,032,363 | B2 * | 10/2011 | Chen et al. | 704/225 |
| 2007/0299669 | A1 | 12/2007 | Ehara | |

FOREIGN PATENT DOCUMENTS

| | | | |
|---|---|---|---|
| JP | 8-500235 | A | 1/1996 |
| JP | 8-272394 | A | 10/1996 |
| JP | 8-292797 | A | 11/1996 |
| JP | 9-212199 | A | 8/1997 |
| JP | 9-244698 | A | 9/1997 |
| JP | 2000-347688 | | 12/2000 |
| JP | 2001-228893 | A | 8/2001 |
| JP | 2003-195900 | A | 7/2003 |
| WO | 94/29851 | A1 | 12/1994 |
| WO | 03/003348 | | 1/2003 |

OTHER PUBLICATIONS

English language Abstract of JP 2003-195900 A.

Massaloux, D. et al., "Spectral Shaping in the Proposed ITU-T 8 kb/s Speech Coding Standard,"; 19950920-19950922, pp. 9-10, XP010269451, Sep. 20, 1995.

Grancharov, V. et al., "Noise-Dependent Postfiltering," Acoustics, Speech, and Signal Processing, 2004. Proceedings. (ICASSP 2004). IEEE International Conference, IEEE, LNKD-DOI; 10.1109/ICASSP.2004.1326021, vol. 1, May 17, 2004, pp. 457-460, XP010717664, ISBN: 978-0-7803-8484-2.

Extended European Search Report dated Nov. 17, 2010 that issued with respect to European Patent Application No. 07807364.0.

Japan Office action, mail date is Apr. 24, 2012.

* cited by examiner

SPEECH ENCODING APPARATUS AND SPEECH ENCODING METHOD

TECHNICAL FIELD

The present invention relates to a speech encoding apparatus and speech encoding method of a CELP (Code-Excited Linear Prediction) scheme. More particularly, the present invention relates to a speech encoding apparatus and speech encoding method for correcting quantization noise to human perceptual characteristics and improving subjective quality of decoded speech signals.

BACKGROUND ART

Up till now, in speech encoding, generally, quantization noise is made hard to be heard by shaping quantization noise in accordance with human perceptual characteristics. For example, in CELP encoding, quantization noise is shaped using a perceptual weighting filter in which the transfer function is expressed by following equation 1.

(Equation 1)

$$W(z) = \frac{A(z/\gamma_1)}{A(z/\gamma_2)} \quad [1]$$

where $0 \le \gamma_2 \le \gamma_1 \le 1$ and $A(z) = 1 + \sum_{i=1}^{M} a_i z^{-i}$ hold.

Equation 1 is equivalent to following equation 2.

(Equation 2)

$$W(z) = \frac{1 + \sum_{i=1}^{M} a_i (z/\gamma_1)^{-i}}{1 + \sum_{i=1}^{M} a_i (z/\gamma_2)^{-i}} \quad [2]$$

Here, $a_i$ represents the LPC (Linear Prediction Coefficient) element acquired in the process of CELP encoding, and M represents the order of the LPC. $\gamma_1$ and $\gamma_2$ are formant weighting coefficients for adjusting the weights of formants in quantization noise. Generally, the values of formant weighting coefficients $\gamma_1$ and $\gamma_2$ are empirically determined by listening. However, optimal values of formant weighting coefficients $\gamma_1$ and $\gamma_2$ vary according to frequency characteristics such as the spectral slope of a speech signal itself, or according to whether or not formant structures are present in a speech signal, and whether or not harmonic structures are present in a speech signal.

Therefore, techniques are suggested for adaptively changing the values of formant weighting coefficients $\gamma_1$ and $\gamma_2$ according to frequency characteristics of an input signal (e.g., see Patent Document 1). In the speech encoding disclosed in Patent Document 1, by adaptively changing the value of formant weighting coefficient $\gamma_2$ according to the spectral slope of a speech signal, the masking level is adjusted. That is, by changing the value of formant weighting coefficient $\gamma_2$ based on features of the speech signal spectrum, it is possible to control a perceptual weighting filter and adaptively adjust the weights of formants in quantization noise. Further, formant weighting coefficients $\gamma_1$ and $\gamma_2$ influence the slope of quantization noise, and, consequently, $\gamma_2$ is controlled including both formant weighting and tilt compensation.

Further, techniques are suggested for switching characteristics of a perceptual weighting filter between a background noise period and a speech period (e.g., see Patent Document 2). In the speech encoding disclosed in Patent Document 2, the characteristics of a perceptual weighting filter are switched depending on whether each period in an input signal is a speech period or a background noise period (i.e., inactive speech period). A speech period is a period in which speech signals are predominant, and a background noise period is a period in which non-speech signals are predominant. According to the techniques disclosed in Patent Document 2, by distinguishing between a background noise period and a speech period and switching the characteristics of a perceptual weighting filter, it is possible to perform perceptual weighting filtering suitable for each period of a speech signal.

Patent Document 1: Japanese Patent Application Laid-Open No. HEI7-86952

Patent Document 2: Japanese Patent Application Laid-Open No. 2003-195900

DISCLOSURE OF INVENTION

Problem to be Solved by the Invention

However, in the speech encoding disclosed in above-described Patent Document 1, the value of formant weighting coefficient $\gamma_2$ is changed based on a general feature of the input signal spectrum, and, consequently, it is not possible to adjust the spectral slope of quantization noise in response to detailed changes in the spectrum. Further, a perceptual weighting filter is controlled using formant weighting coefficient $\gamma_2$, and, consequently, it is not possible to adjust the sharpness of formants and the spectral slope of a speech signal separately. That is, when spectral slope adjustment is performed, there is a problem that, since the adjustment of sharpness of formants is accompanied with the adjustment of spectral slope, the shape of the spectrum collapses.

Further, in the speech encoding disclosed in above-described Patent Document 2, although it is possible to distinguish between a speech period and an inactive speech period and perform perceptual weighting filtering adaptively, there is a problem that it is not possible to perform perceptual weighting filtering suitable for a noise-speech superposition period in which background noise signals and speech signals are superposed on one another.

It is therefore an object of the present invention to provide a speech encoding apparatus and speech encoding method for adaptively adjusting the spectral slope of quantization noise while suppressing influence on the level of formant weighting, and further performing perceptual weighting filtering suitable for a noise-speech superposition period in which background noise signals and speech signals are superposed on one another.

Means for Solving the Problem

The speech encoding apparatus of the present invention employs a configuration having: a linear prediction analyzing section that performs a linear prediction analysis with respect to a speech signal to generate linear prediction coefficients; a quantizing section that quantizes the linear prediction coefficients; a perceptual weighting section that performs perceptual weighting filtering with respect to an input speech signal to generate a perceptual weighted speech signal using a transfer function including a tilt compensation coefficient for adjusting a spectral slope of a quantization noise; a tilt compensation coefficient control section that controls the tilt compensation coefficient using a signal to noise ratio of the speech signal in a first frequency band; and an excitation search section that performs an excitation search of an adaptive codebook and fixed codebook to generate an excitation signal using the perceptual weighted speech signal.

The speech encoding method of the present invention employs a configuration having the steps of: performing a linear prediction analysis with respect to a speech signal and generating linear prediction coefficients; quantizing the linear prediction coefficients; performing perceptual weighting filtering with respect to an input speech signal and generating a perceptual weighted speech signal using a transfer function including a tilt compensation coefficient for adjusting a spectral slope of a quantization noise; controlling the tilt compensation coefficient using a signal to noise ratio in a first frequency band of the speech signal; and performing an excitation search of an adaptive codebook and fixed codebook to generate an excitation signal using the perceptual weighted speech signal.

Advantageous Effect of the Invention

According to the present invention, it is possible to adaptively adjust the spectral slope of quantization noise while suppressing influence on the level of formant weighting, and further perform perceptual weighting filtering suitable for a noise-speech superposition period in which background noise signals and speech signals are superposed on one another.

BEST MODE FOR SOLVING THE PROBLEM

Embodiments of the present invention will be explained below in detail with reference to the accompanying drawings.

Embodiment 1

Figure 1:
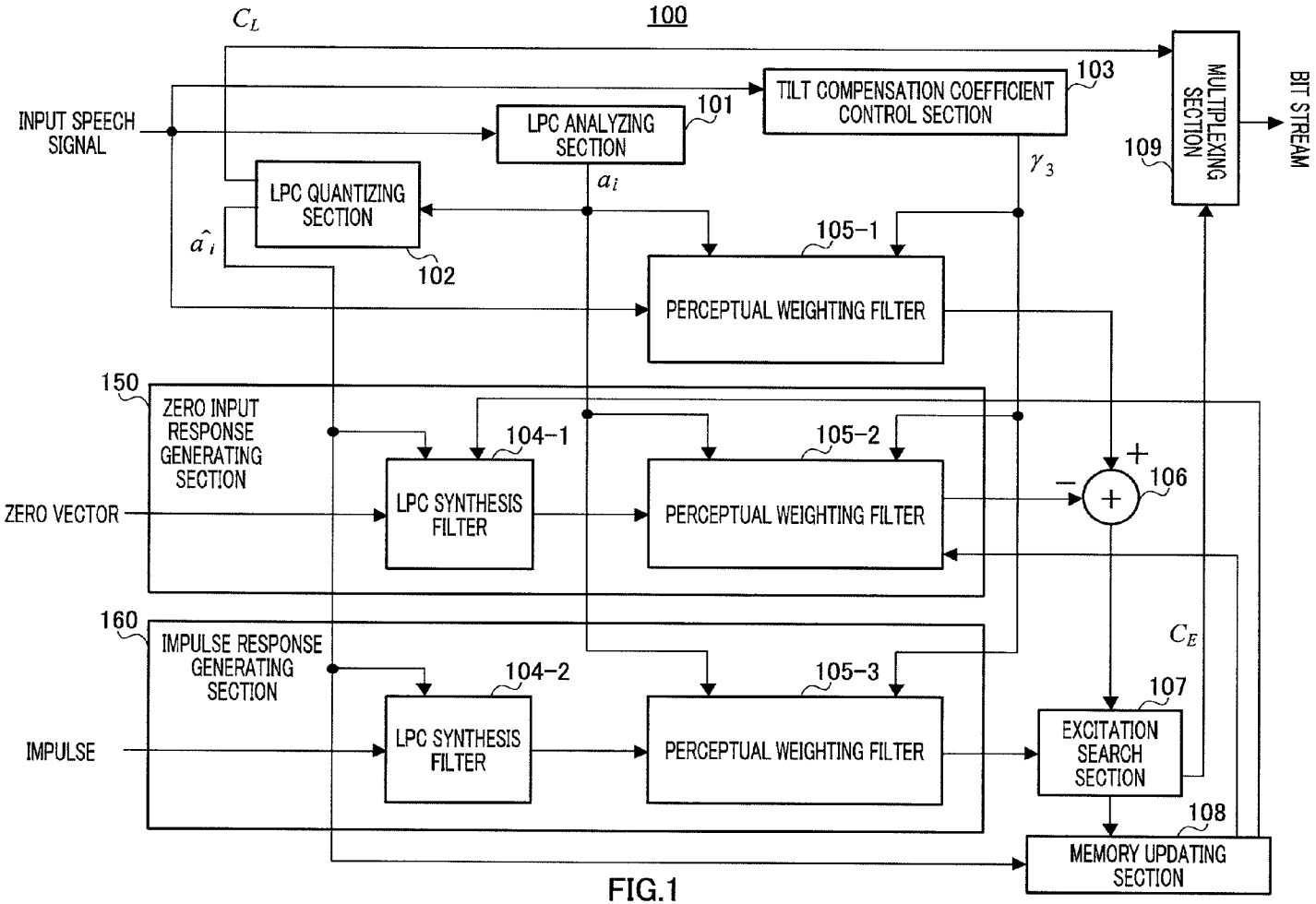
FIG. 1 is a block diagram showing the main components of a speech encoding apparatus according to Embodiment 1 of the present invention.

FIG. 1 is a block diagram showing the main components of speech encoding apparatus 100 according to Embodiment 1 of the present invention.

In FIG. 1, speech encoding apparatus 100 is provided with LPC analyzing section 101, LPC quantizing section 102, tilt compensation coefficient control section 103, LPC synthesis filters 104-1 and 104-2, perceptual weighting filters 105-1, 105-2 and 105-3, adder 106, excitation search section 107, memory updating section 108 and multiplexing section 109. Here, LPC synthesis filter 104-1 and perceptual weighting filter 105-2 form zero input response generating section 150, and LPC synthesis filter 104-2 and perceptual weighting filter 105-3 form impulse response generating section 160.

LPC analyzing section 101 performs a linear prediction analysis with respect to an input speech signal and outputs the linear prediction coefficients to LPC quantizing section 102 and perceptual weighting filters 105-1 to 105-3. Here, LPC is expressed by $a_i$ (i=1, 2, . . . , M), and M is the order of the LPC and an integer greater than one.

LPC quantizing section 102 quantizes linear prediction coefficients $a_i$ received as input from LPC analyzing section 101, outputs the quantized linear prediction coefficients $\hat{a}_i$ to LPC synthesis filters 104-1 to 104-2 and memory updating section 108, and outputs the LPC encoding parameter $C_L$ to multiplexing section 109.

Tilt compensation coefficient control section 103 calculates tilt compensation coefficient $\gamma_3$ to adjust the spectral slope of quantization noise using the input speech signal, and outputs the calculated $\gamma_3$ to perceptual weighting filters 105-1 to 105-3. Tilt compensation coefficient control section 103 will be described later in detail.

LPC synthesis filter 104-1 performs synthesis filtering of a zero vector to be received as input, using the transfer function shown in following equation 3 including quantized linear prediction coefficients $\hat{a}_i$ received as input from LPC quantizing section 102.

(Equation 3)

$$W(z) = \frac{1}{1 + \sum_{i=1}^{M} a\hat{}_i z^{-i}} \quad [3]$$

Further, LPC synthesis filter 104-1 uses as a filter state an LPC synthesis signal fed back from memory updating section 108 which will be described later, and outputs a zero input response signal acquired by synthesis filtering, to perceptual weighting filter 105-2.

LPC synthesis filter 104-2 performs synthesis filtering of an impulse vector received as input using the same transfer function as the transfer function in LPC synthesis filter 104-1, that is, using the transfer function shown in equation 3, and outputs the impulse response signal to perceptual weighting filter 105-3. The filter state in LPC synthesis filter 104-2 is the zero state.

Perceptual weighting filter 105-1 performs perceptual weighting filtering with respect to the input speech signal using the transfer function shown in equation 4 including the linear prediction coefficients $a_i$ received as input from LPC analyzing section 101 and tilt compensation coefficient $\gamma_3$ received as input from tilt compensation coefficient control section 103.

(Equation 4)

$$\frac{1}{1 - \gamma_3 z^{-1}} \times \frac{1 + \sum_{i=1}^{M} a_i (z/\gamma_1)^{-i}}{1 + \sum_{i=1}^{M} a_i (z/\gamma_2)^{-i}} \quad [4]$$

In equation 4, $\gamma_1$ and $\gamma_2$ are formant weighting coefficients. Perceptual weighting filter 105-1 outputs a perceptual weighted speech signal acquired by perceptual weighting filtering, to adder 106. The state in the perceptual weighting filter is updated in the process of the perceptual weighting filtering processing. That is, the filter state is updated using the input signal for the perceptual weighting filter and the perceptual weighted speech signal as the output signal from the perceptual weighting filter.

Perceptual weighting filter 105-2 performs perceptual weighting filtering with respect to the zero input response signal received as input from LPC synthesis filter 104-1, using the same transfer function as the transfer function in perceptual weighting filter 105-1, that is, using the transfer function shown in equation 4, and outputs the perceptual weighted zero input response signal to adder 106. Perceptual weighting filter 105-2 uses the perceptual weighting filter state fed back from memory updating section 108, as the filter state.

Perceptual weighting filter 105-3 performs filtering with respect to the impulse response signal received as input from LPC synthesis filter 104-2, using the same transfer function as the transfer function in perceptual weighting filter 105-1 and perceptual weighting filter 105-2, that is, using the transfer function shown in equation 4, and outputs the perceptual weighted impulse response signal to excitation search section 107. The state in perceptual weighting filter 105-3 is the zero state.

Adder 106 subtracts the perceptual weighted zero input response signal received as input from perceptual weighting filter 105-2, from the perceptual weighted speech signal received as input from perceptual weighting filter 105-1, and outputs the signal as a target signal, to excitation search section 107.

Excitation search section 107 is provided with a fixed codebook, adaptive codebook, gain quantizer and such, and performs an excitation search using the target signal received as input from adder 106 and the perceptual weighted impulse response signal received as input from perceptual weighting filter 105-3, outputs the excitation signal to memory updating section 108 and outputs excitation encoding parameter $C_E$ to multiplexing section 109.

Memory updating section 108 incorporates the same LPC synthesis filter with LPC synthesis filter 104-1 and the same perceptual weighting filter with perceptual weighting filter 105-2. Memory updating section 108 drives the internal LPC synthesis filter using the excitation signal received as input from excitation search section 107, and feeds back the LPC synthesis signal as a filter state to LPC synthesis filter 104-1. Further, memory updating section 108 drives the internal perceptual weighting filter using the LPC synthesis signal generated in the internal LPC synthesis filter, and feeds back the filter state in the perceptual weighting synthesis filter to perceptual weighting filter 105-2. To be more specific, the perceptual weighting filter incorporated in memory updating section 108 is formed with a cascade connection of three filters of a tilt compensation filter expressed by the first term of above equation 4, weighting LPC inverse filter expressed by the numerator of the second term of above equation 4, and weighting LPC synthesis filter expressed by the denominator of the second term of above equation 4, and further feeds back the states in these three filters to perceptual weighting filter 105-2. That is, the output signal of the tilt compensation filter for the perceptual weighting filter, which is incorporated in memory updating section 108, is used as the state in the tilt compensation filter forming perceptual weighting filter 105-2, an input signal of the weighting LPC inverse filter for the perceptual weighting filter, which is incorporated in memory updating section 108, is used as the filter state in the weighting LPC inverse filter of perceptual weighting filter 105-2, and an output signal of the weighting LPC synthesis filter for the perceptual weighting filter, which is incorporated in memory updating section 108, is used as the filter state in the weighting LPC synthesis filter of perceptual weighting filter 105-2.

Multiplexing section 109 multiplexes encoding parameter $C_L$ of quantized LPC ($a_i$) received as input from LPC quantizing section 102 and excitation encoding parameter $C_E$ received as input from excitation search section 107, and transmits the resulting bit stream to the decoding side.

Figure 2:
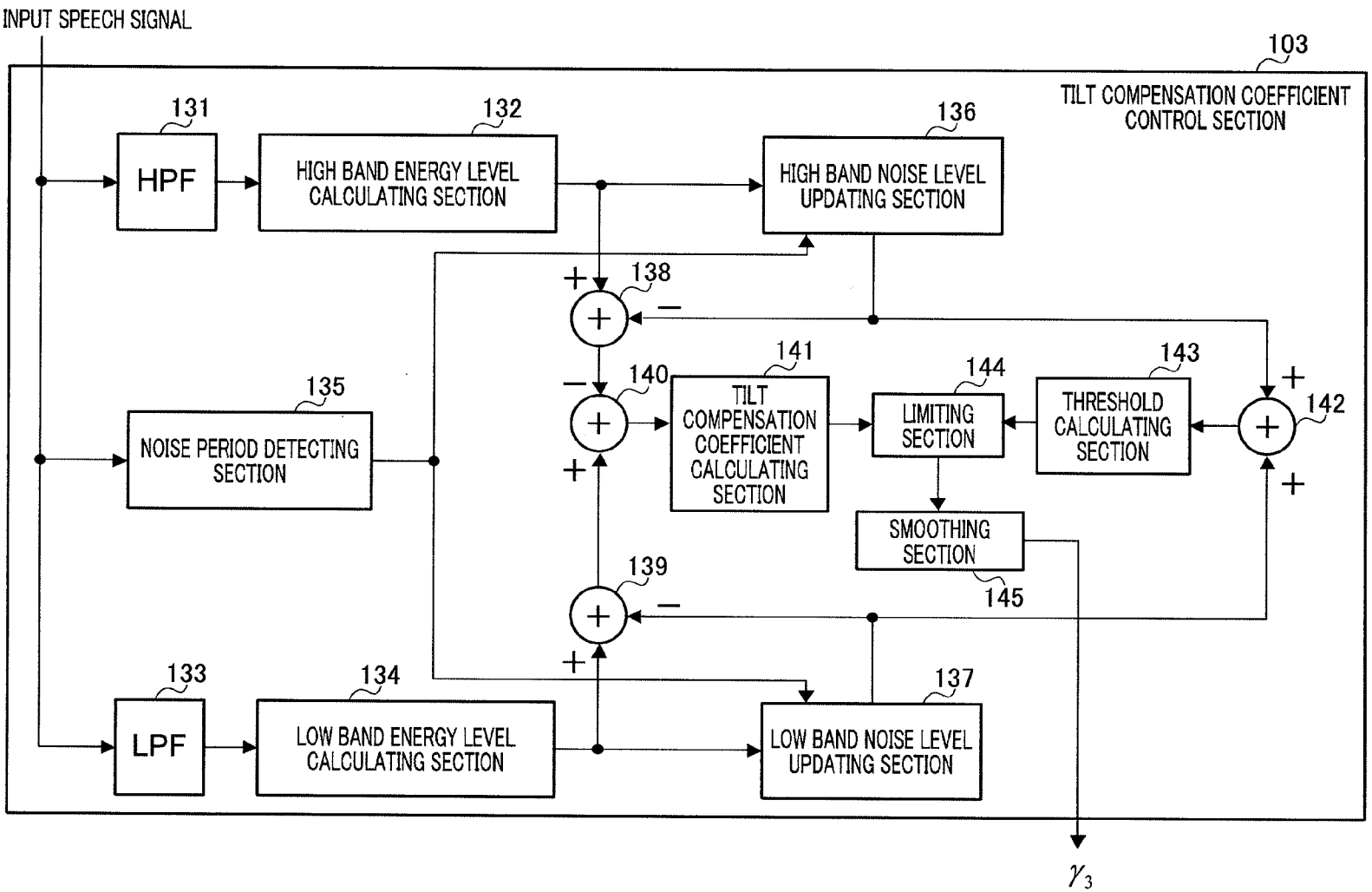
FIG. 2 is a block diagram showing the configuration inside a tilt compensation coefficient control section according to Embodiment 1 of the present invention.

FIG. 2 is a block diagram showing the configuration inside tilt compensation coefficient control section 103. In FIG. 2, tilt compensation coefficient control section 103 is provided with HPF 131, high band energy level calculating section 132, LPF 133, low band energy level calculating section 134, noise period detecting section 135, high band noise level updating section 136, low band noise level updating section 137, adder 138, adder 139, adder 140, tilt compensation coefficient calculating section 141, adder 142, threshold calculating section 143, limiting section 144 and smoothing section 145.

HPF 131 is a high pass filter, and extracts high band components of an input speech signal in the frequency domain and outputs the high band components of speech signal to high band energy level calculating section 132.

High band energy level calculating section 132 calculates the energy level of high band components of speech signal received as input from HPF 131 on a per frame basis, according to following equation 5, and outputs the energy level of high band components of speech signal to high band noise level updating section 136 and adder 138.

$$E_H=10\log_{10}(|A_H|^2) \quad \text{(Equation 5)}$$

In equation 5, $A_H$ represents the high band component vector of speech signal (vector length=frame length) received as input from HPF 131. That is, $|A_H|^2$ is the frame energy of high band components of speech signal. $E_H$ is a decibel representation of $|A_H|^2$ and is the energy level of high band components of speech signal.

LPF 133 is a low pass filter, and extracts low band components of the input speech signal in the frequency domain and outputs the low band components of speech signal to low band energy level calculating section 134.

Low band energy level calculating section 134 calculates the energy level of low band components of the speech signal received as input from LPF 133 on a per frame basis, according to following equation 6, and outputs the energy level of low band components of speech signal to low band noise level updating section 137 and adder 139.

$$E_L=10\log_{10}(|A_L|^2) \quad \text{(Equation 6)}$$

In equation 6, $A_L$ represents the low band component vector of speech signal (vector length=frame length) received as input from LPF 133. That is, $|A_L|^2$ is the frame energy of low band components of speech signal. $E_L$ is a decibel representation of $|A_L|^2$ and is the energy level of the low band component of speech signal.

Noise period detecting section 135 detects whether the speech signal received as input on a per frame basis belongs to a period in which only background noise is present, and, if a frame received as input belongs to a period in which only background noise is present, outputs background noise period detection information to high band noise level updating section 136 and low band noise level updating section 137. Here, a period in which only background noise is present refers to a period in which speech signals to constitute the core of conversation are not present and in which only surrounding noise is present. Further, noise period detecting section 135 will be described later in detail.

High band noise level updating section 136 holds an average energy level of high band components of background noise, and, when the background noise period detection information is received as input from noise period detecting section 135, updates the average energy level of high band components of background noise, using the energy level of the high band components of speech signal, received as input from high band energy level calculating section 132. A method of updating the average energy of high band components of background noise in high band noise level updating section 136 is implemented according to, for example, following equation 7.

$$E_{NH}=\alpha E_{NH}+(1-\alpha)E_H \quad \text{(Equation 7)}$$

In equation 7, $E_H$ represents the energy level of the high band components of speech signal, received as input from high band energy level calculating section 132. If background noise period detection information is received as input from noise period detecting section 135 to high band noise level updating section 136, assume that the input speech signal is comprised of only background noise periods, and that the energy level of high band components of background noise, received as input from high band energy level calculating section 132 to high band noise level updating section 136, that is, $E_H$ in this equation 7 is the energy level of high band components of background noise. $E_{NH}$ represents the average energy level of high band components of background noise, held in high band noise level updating section 136, and $\alpha$ is the long term smoothing coefficient of $0\leqq\alpha\leqq1$. High band noise level updating section 136 outputs the average energy level of high band components of background noise to adder 138 and adder 142.

Low band noise level updating section 137 holds the average energy level of low band components of background noise, and, when the background noise period detection information is received as input from noise period detecting section 135, updates the average level of low band components of background noise, using the energy level of low band components of speech signal, received as input from low band energy level calculating section 134. A method of updating is implemented according to, for example, following equation 8.

$$E_{NL}=\alpha E_{NL}+(1-\alpha)E_L \quad \text{(Equation 8)}$$

In equation 8, $E_L$ represents the energy level of the low band components of speech signal received, as input from low band energy level calculating section 134. If background noise period detection information is received as input from noise period detecting section 135 to low band noise level updating section 137, assume that the input speech signal is comprised of only background noise periods, and that the energy level of low band components of speech signal received as input from low band energy level calculating section 134 to low band noise level updating section 137, that is, $E_L$ in this equation 8, is the energy level of low band components of background noise. $E_{NL}$ represents the average energy level of low band components of background noise held in low band noise level updating section 137, and $\alpha$ is the long term smoothing coefficient of $0\leqq\alpha<1$. Low band noise level updating section 137 outputs the average energy level of the low band components of background noise to adder 139 and adder 142.

Adder 138 subtracts the average energy level of high band components of background noise received as input from high band noise level updating section 136, from the energy level of the high band components of speech signal received as input from high band energy level calculating section 132, and outputs the subtraction result to adder 140. The subtraction result acquired in adder 138 shows the difference between two energy levels showing energy using logarithm, that is, the subtraction result shows the difference between the energy level of the high band components of speech signal and the average energy level of high band components of background noise. Consequently, the subtraction result shows a ratio of these two energies, that is, the ratio between energy of high band components of speech signal and average energy of high band components of background noise. In other words, the subtraction result acquired in adder 138 is the high band SNR (Signal-to-Noise Ratio) of a speech signal.

Adder 139 subtracts the average energy level of low band components of background noise received as input from low band noise level updating section 137, from the energy level of low band components of speech signal received as input from low band energy level calculating section 134, and outputs the subtraction result to adder 140. The subtraction result acquired in adder 139 shows the difference between two energy levels represented by logarithm, that is, the subtraction result shows the difference between the energy level of the low band components of speech signal and the average energy level of low band components of background noise. Consequently, the subtraction result shows a ratio of these two energies, that is, the ratio between energy of low band components of speech signal and long term average energy of low band components of background noise signal. In other words, the subtraction result acquired in adder 13 is the low band SNR of a speech signal.

Adder 140 performs subtraction processing of the high band SNR received as input from adder 138 and the low band SNR received as input from adder 139, and outputs the difference between the high band SNR and the low band SNR, to tilt compensation coefficient calculating section 141.

Tilt compensation coefficient calculating section 141 calculates tilt compensation coefficient before smoothing, $\gamma_3'$, according to, for example, following equation 9, using the difference received as input from adder 140 between the high band SNR and the low band SNR, and outputs the calculated tilt compensation coefficient $\gamma_3'$ to limiting section 144.

$$\gamma_3' = \beta(\text{low band SNR} - \text{high band SNR}) + C \quad \text{(Equation 9)}$$

In equation 9, $\gamma_3'$ represents the tilt compensation coefficient before smoothing, $\beta$ represents a predetermined coefficient and C represents the bias component. As shown in equation 9, tilt compensation coefficient calculating section 141 calculates the tilt compensation coefficient before smoothing, $\gamma_3'$, using a function where $\gamma_3'$ increases in proportion to the difference between the low band SNR and the high band SNR. If perceptual weighting filters 105-1 to 105-3 perform shaping of quantization noise using the tilt compensation coefficient before smoothing, $\gamma_3'$, when the low band SNR is higher than the high band SNR, weighting with respect to error of the low band components of an input speech signal becomes significant and weighting with respect to error of the high band components becomes insignificant relatively, and therefore the high band components of the quantization noise is shaped higher. By contrast, when the high band SNR is higher than the low band SNR, weighting with respect to error of the high band components of an input speech signal becomes significant and weighting with respect to error of the low band components becomes insignificant relatively, and therefore the low band components of the quantization noise is shaped higher.

Adder 142 adds the average energy level of high band components of background noise received as input from high band noise level updating section 136 and the average energy level of low band components of background noise received as input from low band noise level updating section 137, and outputs the average energy level of background noise acquired as the addition result to threshold calculating section 143.

Threshold calculating section 143 calculates an upper limit value and lower limit value of tilt compensation coefficient before smoothing, $\gamma_3'$, using the average energy level of background noise received as input from adder 142, and outputs the calculated upper limit value and lower limit value to limiting section 144. To be more specific, the lower limit value of the tilt compensation coefficient before smoothing is calculated using a function that approaches constant L when the average energy level of background noise received as input from adder 142 is lower, such as a function (lower limit value=$\sigma\times$average energy level of background noise+L, where $\sigma$ is a constant). However, it is necessary not to make the lower limit value too low, that is, it is necessary not to make the lower limit value below a fixed value. This fixed value is referred to as the "lowermost limit value." On the other hand, the upper limit value of the tilt compensation coefficient before smoothing is fixed to a constant that is determined empirically. For the equation for the lower limit value and the fixed value of the upper limit value, a proper calculation formula and value vary according to the performance of the HPF and LPF, bandwidth of the input speech signal, and so on. For example, in the above-described equation for the lower limit value, the lower limit value may be calculated using $\sigma$=0.003 and L=0 upon encoding a narrowband signal and using $\sigma$=0.001 and L=0.6 upon encoding a wideband signal. Further, the upper limit value may be set around 0.6 upon encoding a narrowband signal and around 0.9 upon encoding a wideband signal. Further, the lowermost limit value may be set around −0.5 upon encoding a narrowband signal and around 0.4 upon encoding a wideband signal. Necessity for setting the lower limit value of tilt compensation coefficient before smoothing, $\gamma_3'$, using the average energy level of background noise, will be explained. As described above, weighting with respect to low band components becomes insignificant when $\gamma_3'$ is smaller, and low band quantization noise is shaped high. However, the energy of a speech signal is generally concentrated in the low band, and, consequently, in almost all of the cases, it is proper to shape low band quantization noise low. Therefore, shaping low band quantization noise high needs to be performed carefully. For example, when the average energy level of background noise is extremely low, the high band SNR and low band SNR calculated in adder 138 and adder 139 are likely to be influenced by the accuracy of noise period detection in noise period detecting section 135 and local noise, and, consequently, the reliability of tilt compensation coefficient before smoothing, $\gamma_3'$, calculated in tilt compensation coefficient calculating section 141, may decrease. In this case, the low band quantization noise may be shaped too high by mistake, which makes the low band quantization noise too high, and, consequently, a method of preventing this is required. According to the present embodiment, by determining the lower limit value of $\gamma_3'$ using a function where the lower limit value of $\gamma_3'$ is set larger when the average energy level of background noise decreases, the low band components of quantization noise are not shaped too high when the average energy level of background noise is low.

Limiting section 144 adjusts the tilt compensation coefficient before smoothing, $\gamma_3'$, received as input from tilt compensation coefficient calculating section 141 to be included in the range determined by the upper limit value and lower limit value received as input from threshold calculating section 143, and outputs the results to smoothing section 145. That is, when the tilt compensation coefficient before smoothing, $\gamma_3'$, exceeds the upper limit value, the tilt compensation coefficient before smoothing, $\gamma_3'$, is set as the upper limit value, and, when the tilt compensation coefficient before smoothing, $\gamma_3'$, falls below the lower limit value, the tilt compensation coefficient before smoothing, $\gamma_3'$, is set as the lower limit value.

Smoothing section 145 smoothes the tilt compensation coefficient before smoothing, $\gamma_3'$, on a per frame basis using following equation 10, and outputs the tilt compensation coefficient $\gamma_3'$ to perceptual weighting filters 105-1 to 105-3.

$$\gamma_3=\beta\gamma_3+(1-\beta)\gamma_3' \quad \text{(Equation 10)}$$

In equation 10, $\beta$ is the smoothing coefficient where $0\leqq\beta<1$.

Figure 3:
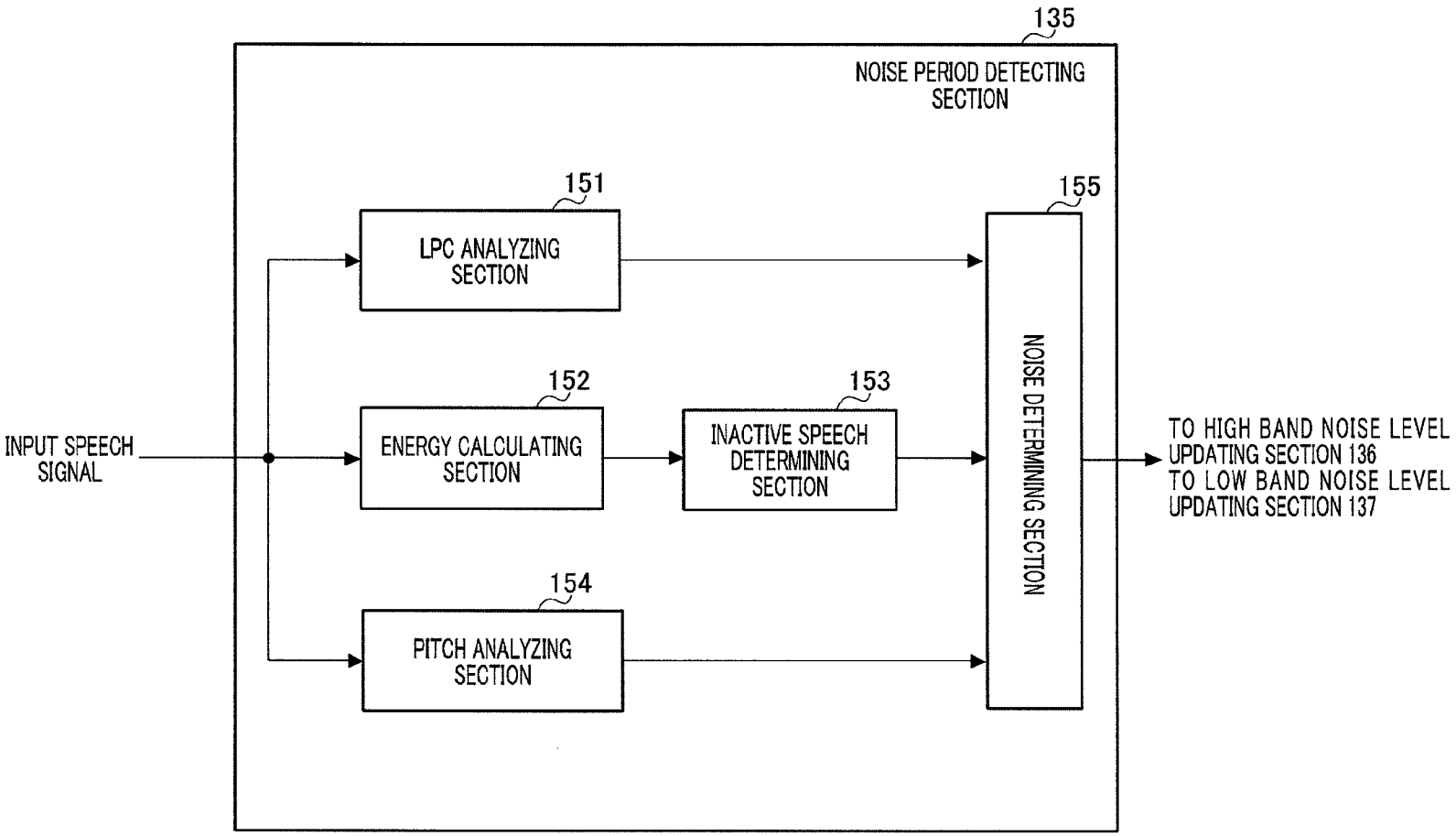
FIG. 3 is a block diagram showing the configuration inside a noise period detecting section according to Embodiment 1 of the present invention.

FIG. 3 is a block diagram showing the configuration inside noise period detecting section 135.

Noise period detecting section 135 is provided with LPC analyzing section 151, energy calculating section 152, inactive speech determining section 153, pitch analyzing section 154 and noise determining section 155.

LPC analyzing section 151 performs a linear prediction analysis with respect to an input speech signal and outputs a square mean value of the linear prediction residue acquired in the process of the linear prediction analysis. For example, when the Levinson Durbin algorithm is used as a linear prediction analysis, a square mean value itself of the linear prediction residue is acquired as a byproduct of the linear prediction analysis.

Energy calculating section 152 calculates the energy of input speech signal on a per frame basis, and outputs the results as speech signal energy to inactive speech determining section 153.

Inactive speech determining section 153 compares the speech signal energy received as input from energy calculating section 152 with a predetermined threshold, and, if the speech signal energy is less than the predetermined threshold, determines that the speech signal is inactive speech, and, if the speech signal energy is equal to or greater than the threshold, determines that the speech signal in a frame of the encoding target is active speech, and outputs the inactive speech determining result to noise determining section 155.

Pitch analyzing section 154 performs a pitch analysis with respect to the input speech signal and outputs the pitch prediction gain to noise determining section 155. For example, when the order of the pitch prediction performed in pitch analyzing section 154 is one, a pitch prediction analysis finds T and gp minimizing $\Sigma|x(n)-gp\times x(n-T)|^2$, $n=0, \ldots, L-1$. Here, L is the frame length, T is the pitch lag and gp is the pitch gain, and the relationship $gp=\Sigma x(n)\times x(n-T)/\Sigma x(n-T)\times x(n-T)$, $n=0, \ldots, L-1$ holds. Further, a pitch prediction gain is expressed by (a square mean value of the speech signal)/(a square mean value of the pitch prediction residue), and is also expressed by $1/(1-(|\Sigma x(n-T)x(n)|^2/\Sigma x(n)x(n)\times\Sigma x(n-T)x(n-T)))$. Therefore, pitch analyzing section 154 uses $|\Sigma x(n-T)x(n)|\hat{}2/(\Sigma x(n)x(n)\times\Sigma x(n-T)x(n-T))$ as a parameter to express the pitch prediction gain.

Noise determining section 155 determines, on a per frame basis, whether the input speech signal is a noise period or speech period, using the square mean value of a linear prediction residue received as input from LPC analyzing section 151, the inactive speech determination result received as input from inactive speech determining section 153 and the pitch prediction gain received as input from pitch analyzing section 154, and outputs the determination result as a noise period detection result to high band noise level updating section 136 and low band noise level updating section 137. To be more specific, when the square mean value of the linear prediction residue is less than a predetermined threshold and the pitch prediction gain is less than a predetermined threshold, or when the inactive speech determination result received as input from inactive speech determining section 153 shows an inactive speech period, noise determining section 155 determines that the input speech signal is a noise period, and otherwise determines that the input speech signal is a speech period.

Figure 4:
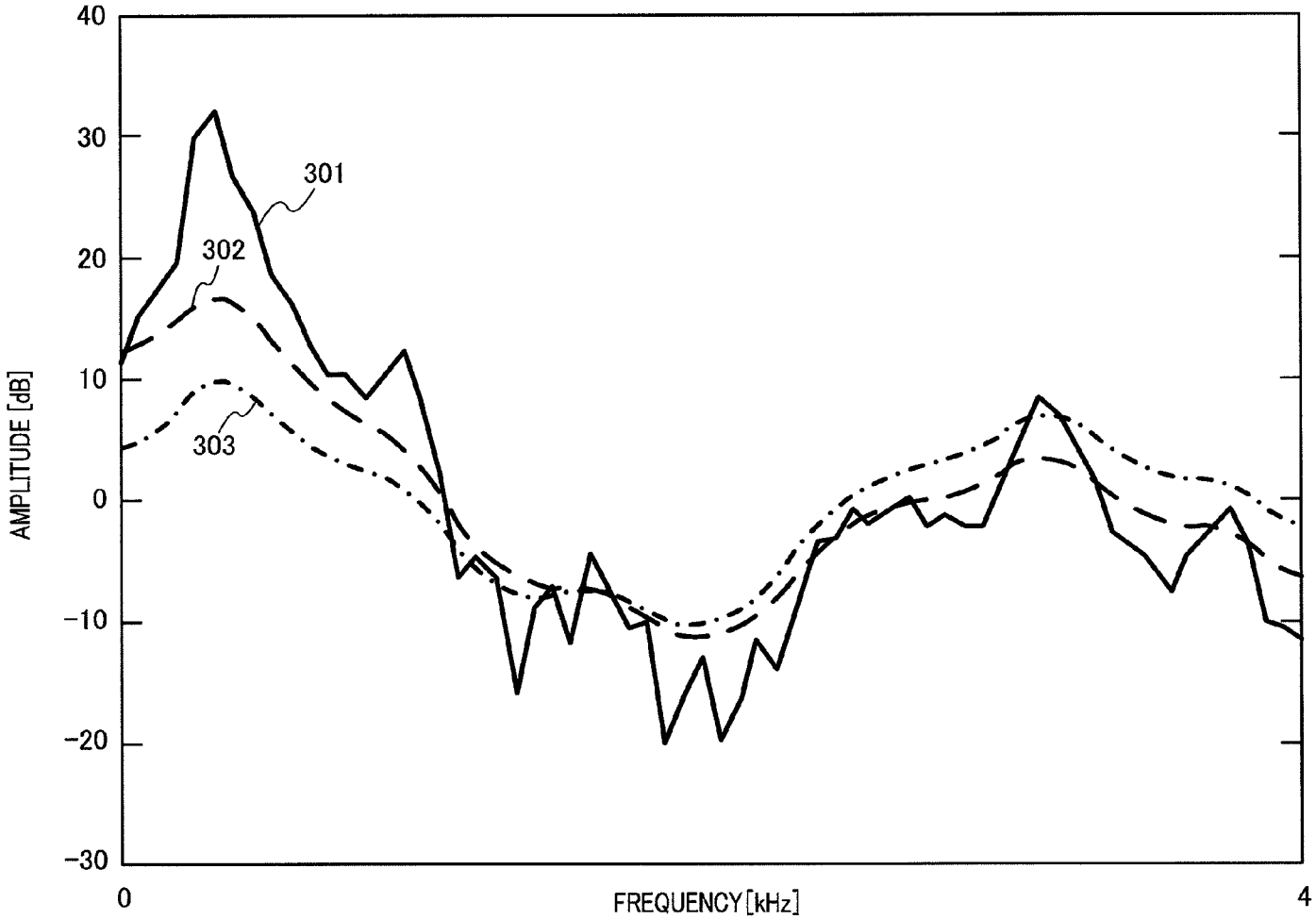
FIG. 4 illustrates an effect acquired by shaping quantization noise of a speech signal in a speech period in which speech is predominant over background noise, using a speech encoding apparatus according to Embodiment 1 of the present invention.

FIG. 4 illustrates an effect acquired by shaping quantization noise with respect to a speech signal in a speech period in which speech is predominant over background noise, using speech encoding apparatus 100 according to the present embodiment.

In FIG. 4, solid line graph 301 shows an example of a speech signal spectrum in a speech period in which speech is predominant over background noise. Here, as a speech signal, a speech signal of "HÎ" as in "KÔHÎ" pronounced by a woman, is exemplified. If speech encoding apparatus 100 without tilt compensation coefficient control section 103 shapes quantization noise, dotted line graph 302 shows the resulting quantization noise spectrum. When quantization noise is shaped using speech encoding apparatus 100 according to the present embodiment, dashed line graph 303 shows the resulting quantization noise spectrum.

In the speech signal shown by solid line graph 301, the difference between the low band SNR and the high band SNR is substantially equivalent to the difference between the low band component energy and the high band component energy. Here, the low band component energy is higher than the high band component energy, and, consequently, the low band SNR is higher than the high band SNR. As shown in FIG. 4, when the low band SNR of the speech signal is higher than the high band SNR, speech encoding apparatus 100 with tilt compensation coefficient control section 103 shapes the high band components of the quantization noise higher. That is, as shown in dotted line graph 302 and dashed line graph 303, when quantization noise is shaped with respect to a speech signal in a speech period using the speech encoding apparatus 100 according to the present embodiment, it is possible to suppress the low band parts of the quantization noise spectrum than when a speech encoding apparatus without tilt compensation coefficient control section 103 is used.

Figure 5:
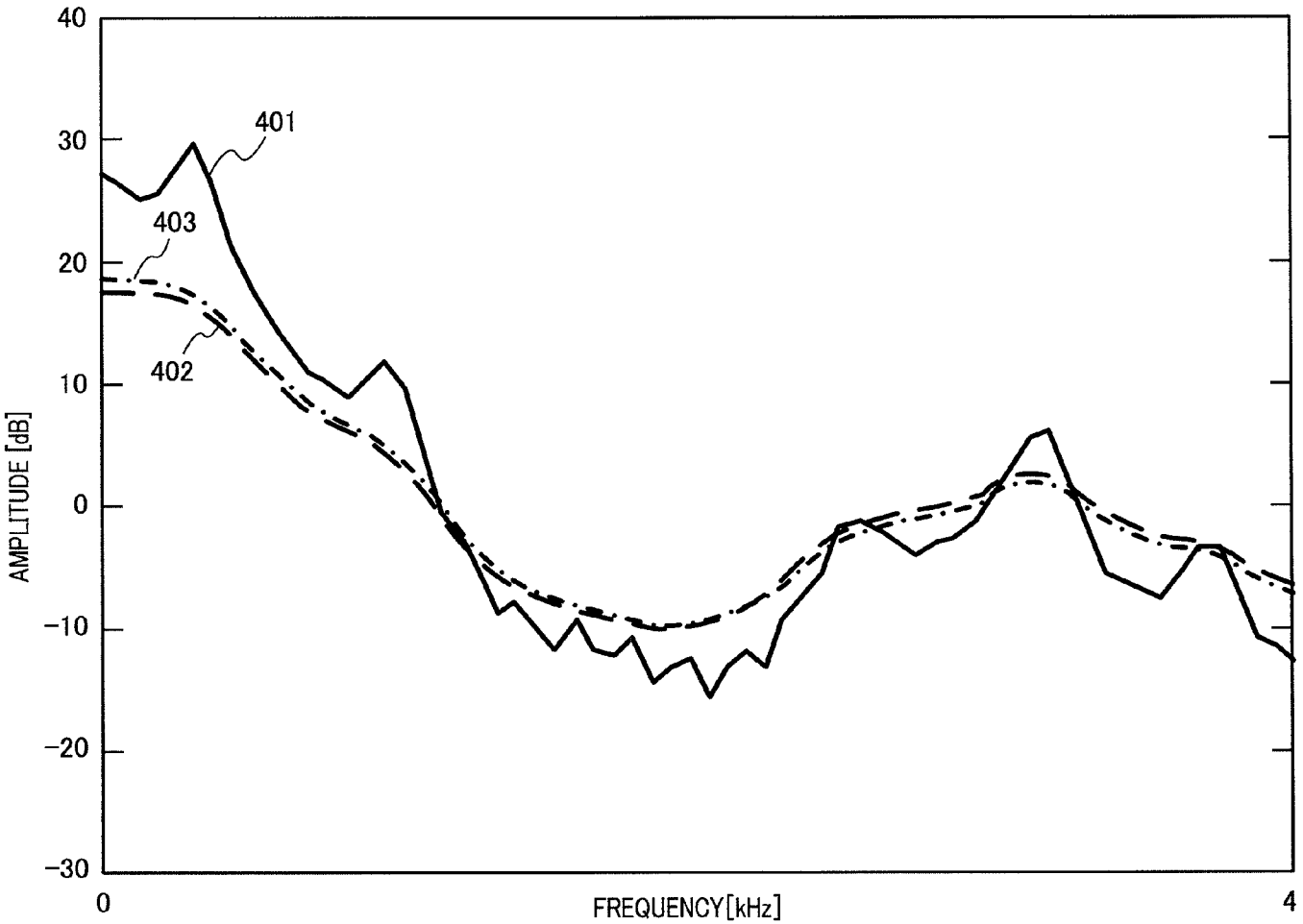
FIG. 5 illustrates an effect acquired by shaping quantization noise of a speech signal in a noise-speech superposition period in which background noise and speech are superposed on one another, using a speech encoding apparatus according to Embodiment 1 of the present invention.

FIG. 5 illustrates an effect acquired by shaping quantization noise with respect to a speech signal in a noise-speech superposition period in which background noise such as car noise and speech are superposed on one another, using speech encoding apparatus 100 according to the present embodiment.

In FIG. 5, solid line graph 401 shows a spectrum example of a speech signal in a noise-speech superposition period in which background noise and speech are superposed on one another. Here, as a speech signal, a speech signal of "HÎ" as in "KÔHÎ" pronounced by a woman, is exemplified. Dashed line graph 402 shows the spectrum of quantization noise spectrum which speech encoding apparatus 100 without tilt compensation coefficient control section 103 acquires by shaping the quantization noise. Dashed line graph 403 shows the spectrum of quantization noise acquired upon shaping the quantization noise using speech encoding apparatus 100 according to the present embodiment.

In the speech signal shown by solid line graph 401, the high band SNR is higher than the low band SNR. As shown in FIG. 5, when the high band SNR of the speech signal is higher than the low band SNR, speech encoding apparatus 100 with tilt compensation coefficient control section 103 shapes the low band components of the quantization noise higher. That is, as shown in dotted line graph 402 and dashed line 403, when quantization noise is shaped with respect to a speech signal in a noise-speech superposition period using speech encoding apparatus 100 according to the present embodiment, it is possible to suppress the high band parts of the quantization noise spectrum more than when a speech encoding apparatus without tilt compensation coefficient control section 103 is used.

As described above, according to the present embodiment, the adjustment function for the spectral slope of quantization noise is further compensated using a synthesis filter comprised of tilt compensation coefficient $\gamma_3$, so that it is possible to adjust the spectral slope of quantization noise without changing formant weighting.

Further, according to the present embodiment, tilt compensation coefficient $\gamma_3$ is calculated using a function about the difference between the low band SNR and high band SNR of the speech signal, and a threshold for tilt compensation coefficient $\gamma_3$ is controlled using the energy of background noise of the speech signal, so that it is possible to perform perceptual weighting filtering suitable for speech signals in a noise-speech superposition period in which background noise and speech are superposed on one another.

Further, although an example case has been described above with the present embodiment where a filter expressed by $1/(1-\gamma_3 z^{-1})$ is used as a tilt compensation filter, it is equally possible to use other tilt compensation filters. For example, it is possible to use a filter expressed by $1+\gamma_3 z^{-1}$. Further, the value of $\gamma_3$ can be changed adaptively and used.

Further, although an example case has been described above with the present embodiment where the value found by a function about the average energy level of background noise is used as the lower limit value of tilt compensation coefficient before smoothing, $\gamma_3$, and a predetermined fixed value is used as the upper limit value of the tilt compensation coefficient before smoothing, it is equally possible to use predetermined fixed values based on experimental data or empirical data as the upper limit value and lower limit value.

Embodiment 2

Figure 6:
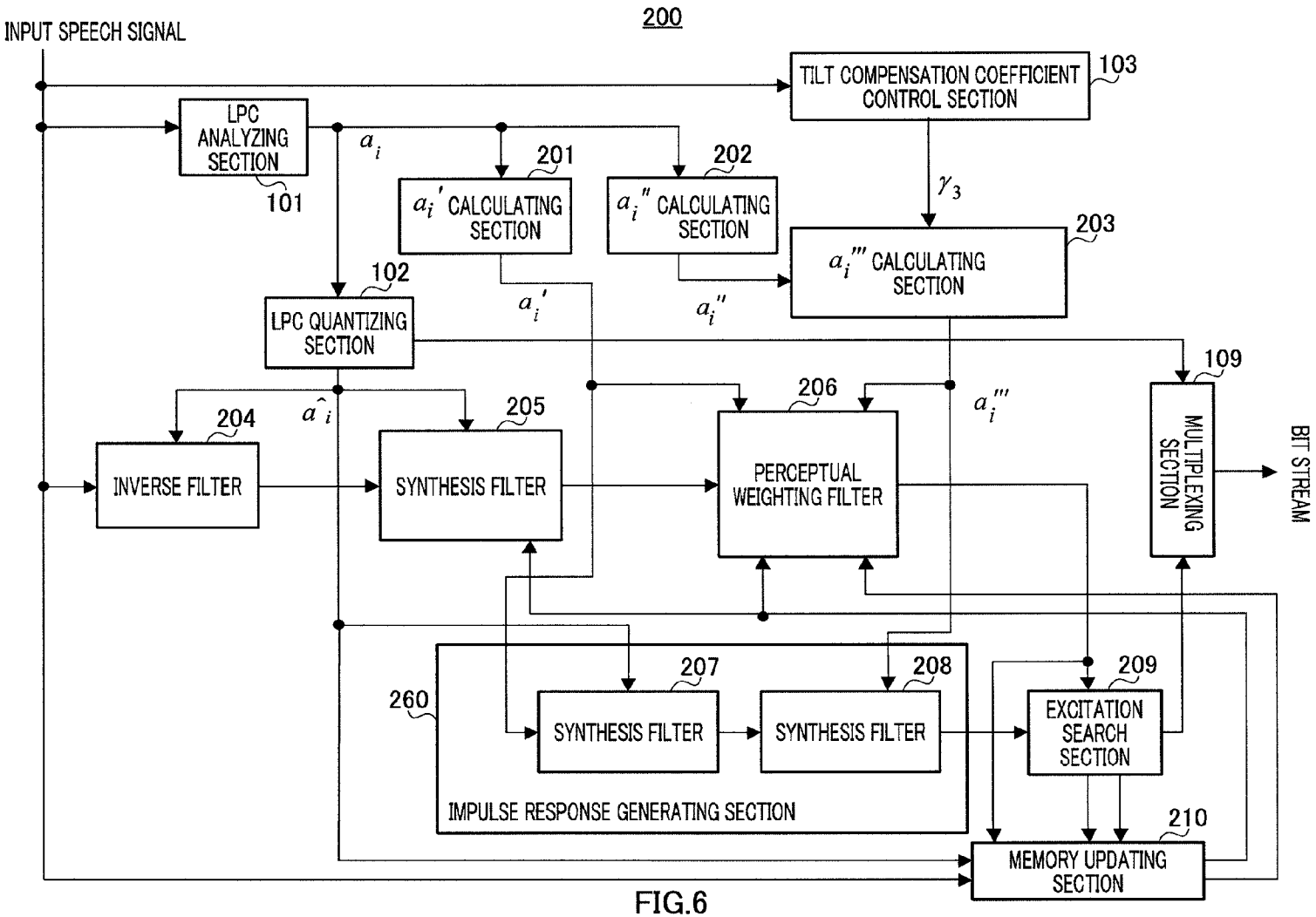
FIG. 6 is a block diagram showing the main components of a speech encoding apparatus according to Embodiment 2 of the present invention.

FIG. 6 is a block diagram showing the main components of speech encoding apparatus 200 according to Embodiment 2 of the present invention.

In FIG. 6, speech encoding apparatus 200 is provided with LPC analyzing section 101, LPC quantizing section 102, tilt compensation coefficient control section 103 and multiplexing section 109, which are similar to in speech encoding apparatus 100 (see FIG. 1) shown in Embodiment 1, and therefore explanations of these sections will be omitted. Speech encoding apparatus 200 is further provided with $a_i'$ calculating section 201, $a_i''$ calculating section 202, $a_i'''$ calculating section 203, inverse filter 204, synthesis filter 205, perceptual weighting filter 206, synthesis filter 207, synthesis filter 208, excitation search section 209 and memory updating section 210. Here, synthesis filter 207 and synthesis filter 208 form impulse response generating section 260.

$a_i'$ calculating section 201 calculates weighted linear prediction coefficients $a_i'$ according to following equation 11 using linear prediction coefficients $a_i$ received as input from LPC analyzing section 101, and outputs the calculated $a_i'$ to perceptual weighting filter 206 and synthesis filter 207.

$$\alpha_i'=\gamma_1^i\alpha_i,\ i=1,\ldots,M \qquad \text{(Equation 11)}$$

In equation 11, $\gamma_1$ represents the first formant weighting coefficient. The weighting linear prediction coefficients $a_i'$ is used for perceptual weighting filtering in perceptual weighting filter 206 which will be described later.

$a_i''$ calculating section 202 calculates weighted linear prediction coefficients $a_i''$ according to following equation 12 using a linear prediction coefficient $a_i$ received as input from LPC analyzing section 101, and outputs the calculated $a_i''$ to $a_i'''$ calculating section 203. Although the weighted linear prediction coefficients $a_i''$ are used in perceptual weighting filter 105 in FIG. 1, in this case, the weighted linear prediction coefficients $a_i''$ are used to only calculate weighted linear prediction coefficients $a_i'''$ containing tilt compensation coefficient $\gamma_3$.

$$a_i''=\gamma_2^i\alpha_i,\ i=1,\ldots,M \qquad \text{(Equation 12)}$$

In equation 12, $\gamma_2$ represents the second formant weighting coefficient.

$a_i'''$ calculating section 203 calculates weighted linear prediction coefficients $a_i'''$ according to following equation 13 using a tilt compensation coefficient $\gamma_3$ received as input from tilt compensation coefficient control section 103 and the $a_i''$ received as input from $a_i''$ calculating section 202, and outputs the calculated $a_i'''$ to perceptual weighting filter 206 and synthesis filter 208.

$$\alpha_i'''=\alpha_i''-\gamma_3\alpha_{i-1}'',$$

$$\alpha_0'''=1.0,\ i=1,\ldots,M+1 \qquad \text{(Equation 13)}$$

In equation 13, $\gamma_3$ represents the tilt compensation coefficient. The weighted linear prediction coefficient $a_i'''$ includes tilt compensation coefficient and is used in perceptual weighting filtering in perceptual weighting filter 206.

Inverse filter 204 performs inverse filtering of an input speech signal using the transfer function shown in following equation 14 including quantized linear prediction coefficients $\hat{a}_i$ received as input from LPC quantizing section 102.

(Equation 14)

$$W(z)=1+\sum_{i=1}^{M}\hat{a}_i z^{-i} \qquad [8]$$

The signal acquired by inverse filtering in inverse filter 204 is a linear prediction residue signal calculated using a quantized linear prediction coefficients $\hat{a}_i$. Inverse filter 204 outputs the resulting residue signal to synthesis filter 205.

Synthesis filter 205 performs synthesis filtering of the residue signal received as input from inverse filter 204 using the transfer function shown in following equation 15 including quantized linear prediction coefficients $\hat{a}_i$ received as input from LPC quantizing section 102.

(Equation 15)

$$W(z) = \frac{1}{1 + \sum_{i=1}^{M} a\hat{}_i z^{-i}} \quad [9]$$

Further, synthesis filter 205 uses as a filter state the first error signal fed back from memory updating section 210 which will be described later. A signal acquired by synthesis filtering in synthesis filter 205 is equivalent to a synthesis signal from which a zero input response signal is removed. Synthesis filter 205 outputs the resulting synthesis signal to perceptual weighting filter 206.

Perceptual weighting filter 206 is formed with an inverse filter having the transfer function shown in following equation 16 and synthesis filter having the transfer function shown in following equation 17, and is a pole-zero type filter. That is, the transfer function in perceptual weighting filter 206 is expressed by following equation 18.

(Equation 16)

$$W(z) = 1 + \sum_{i=1}^{M} a_i' z^{-i} \quad [10]$$

(Equation 17)

$$W(z) = \frac{1}{1 + \sum_{i=1}^{M+1} a_i''' z^{-i}} \quad [11]$$

(Equation 18)

$$W(z) = \frac{1 + \sum_{i=1}^{M} a_i' z^{-i}}{1 + \sum_{i=1}^{M+1} a_i''' z^{-i}} \quad [12]$$

In equation 16, $a_i'$ represents the weighting linear prediction coefficient received as input from $a_i'$ calculating section 201, and, in equation 17, $a_i'''$ represents the weighting linear prediction coefficient containing tilt compensation coefficient $\gamma_3$ received as input from $a_i'''$ calculating section 203. Perceptual weighting filter 206 performs perceptual weighting filtering with respect to the synthesis signal received as input from synthesis filter 205, and outputs the resulting target signal to excitation search section 209 and memory updating section 210. Further, perceptual weighting filter 206 uses as a filter state a second error signal fed back from memory updating section 210.

Synthesis filter 207 performs synthesis filtering with respect to the weighting linear prediction coefficients $a_i'$ received as input from $a_i'$ calculating section 201 using the same transfer function as in synthesis filter 205, that is, using the transfer function shown in above-described equation 15, and outputs the synthesis signal to synthesis filter 208. As described above, the transfer function shown in equation 15 includes quantized linear prediction coefficients $a\hat{}_i$ received as input from LPC quantizing section 102.

Synthesis filter 208 further performs synthesis filtering with respect to the synthesis signal received as input from synthesis filter 207, that is, performs filtering of a pole filter part of the perceptual weighting filtering, using the transfer function shown in above-described equation 17 including weighted linear prediction coefficients $a_i'''$ received as input from $a_i'''$ calculating section 203. A signal acquired by synthesis filtering in synthesis filter 208 is equivalent to a perceptual weighted impulse response signal. Synthesis filter 208 outputs the resulting perceptual weighted impulse response signal to excitation search section 209.

Excitation search section 209 is provided with a fixed codebook, adaptive codebook, gain quantizer and such, receives as input the target signal from perceptual weighting filter 206 and the perceptual weighted impulse response signal from synthesis filter 208. Excitation search section 209 searches for an excitation signal minimizing error between the target signal and the signal acquired by convoluting the perceptual weighted impulse response signal with the searched excitation signal. Excitation search section 209 outputs the searched excitation signal to memory updating section 210 and outputs the encoding parameter of the excitation signal to multiplexing section 109. Further, excitation search section 209 outputs a signal, which is acquired by convoluting the perceptual weighted impulse response signal with the excitation signal, to memory updating section 210.

Memory updating section 210 incorporates the same synthesis filter as synthesis filter 205, drives the internal synthesis filter using the excitation signal received as input from excitation search section 209, and, by subtracting the resulting signal from the input speech signal, calculates the first error signal. That is, an error signal is calculated between an input speech signal and a synthesis speech signal synthesized using the encoding parameter. Memory updating section 210 feeds back the calculated first error signal as a filter state, to synthesis filter 205 and perceptual weighting filter 206. Further, memory updating section 210 calculates a second error signal by subtracting the signal acquired by superposing a perceptual weighted impulse response signal over the speech signal received as input from excitation search section 209, from the target signal received as input from perceptual weighting filter 206. That is, an error signal is calculated between the perceptual weighting input signal and a perceptual weighting synthesis speech signal synthesized using the encoding parameter. Memory updating section 210 feeds back the calculated second error signal as a filter state to perceptual weighting filter 206. Further, perceptual weighting filter 206 is a cascade connection filter formed with the inverse filter represented by equation 16 and the synthesis filter represented by equation 17, and the first error signal and the second error signal are used as the filter state in the inverse filter and the filter state in the synthesis filter, respectively.

Speech encoding apparatus 200 according to the present embodiment employs a configuration acquired by changing speech encoding apparatus 100 shown in Embodiment 1. For example, perceptual weighting filters 105-1 to 105-3 of speech encoding apparatus 100 are equivalent to perceptual weighting filter 206 of speech encoding apparatus 200. Following equation 19 is an equation developed from a transfer function to show that perceptual weighting filters 105-1 to 105-3 100 are equivalent to perceptual weighting filter 206.

(Equation 19)

[13

$$
\begin{aligned}
W(z) &= \frac{1}{1-\gamma_3 z^{-1}} \times \frac{1+\sum_{i=1}^{M} a_i (z/\gamma_1)^{-i}}{1+\sum_{i=1}^{M} a_i (z/\gamma_2)^{-i}} \\
&= \frac{1+\sum_{i=1}^{M} a_i (z/\gamma_1)^{-i}}{1-\gamma_3 z^{-1}+\sum_{i=1}^{M} (\gamma_2^i a_i) z^{-1} - \sum_{i=1}^{M} \gamma_3 (\gamma_2^i a_i) z^{-i-1}} \\
&= \frac{1+\sum_{i=1}^{M} a_i (z/\gamma_1)^{-i}}{1-\gamma_3 z^{-1}+\sum_{i=1}^{M} (\gamma_2^i a_i) z^{i} - \gamma_3 \sum_{i=2}^{M+1} (\gamma_2^{i-1} a_{i-1}) z^{-i}} \\
&= \frac{1+\sum_{i=1}^{M} a_i (z/\gamma_1)^{-i}}{1-\gamma_3 z^{-1}+(\gamma_2 a_1) z^{-1} + \sum_{i=2}^{M} (\gamma_2^i a_i) z^{-i} - \gamma_3 \sum_{i=2}^{M} (\gamma_2^{i-1} a_{i-1}) z^{-i} - \gamma_3 (\gamma_2^M a_M) z^{-M-1}} \\
&= \frac{1+\sum_{i=1}^{M} a_i (z/\gamma_1)^{-i}}{1-\gamma_3 z^{-1}+(\gamma_2 a_1) z^{-1} + \sum_{i=2}^{M} ((\gamma_2^i a_i) - \gamma_3 (\gamma_2^{i-1} a_{i-1})) z^{-i} - \gamma_3 (\gamma_2^M a_M) z^{-M-1}} \\
&= \frac{1+\sum_{i=1}^{M} a_i (z/\gamma_1)^{-i}}{1-\gamma_3 (\gamma_2^0 a_0) z^{-1} + (\gamma_2 a_1) z^{-1} + \sum_{i=2}^{M} ((-\gamma_2^i a_i) - \gamma_3 (\gamma_2^{i-1} a_{i-1})) z^{-i} + (\gamma_2^{M+1} a_{M+1}) z^{-M-1} - \gamma_3 (\gamma_2^M a_M) z^{-M-1} \big|_{a_0=1.0 \cdot a_{M+1}=0.0}} \\
&= \frac{1+\sum_{i=1}^{M} a_i (z/\gamma_1)^{-i}}{1+((\gamma_2 a_1) z^{-1} - \gamma_3 (\gamma_2^0 a_0) z^{-1}) + \sum_{i=2}^{M} ((\gamma_2^i a_i) - \gamma_3 (\gamma_2^{i-1} a_{i-1})) z^{-i} + ((\gamma_2^{M+1} a_{M+1}) z^{-M-1} - \gamma_3 (\gamma_2^M a_M) z^{-M-1}) \big|_{a_0=1.0 \cdot a_{M+1}=0.0}} \\
&= \frac{1+\sum_{i=1}^{M} a_i (z/\gamma_1)^{-i}}{1+\sum_{i=1}^{M+1} ((\gamma_2^i a_i) - \gamma_3 (\gamma_2^{i-1} a_{i-1})) z^{-i} \Big|_{a_0=1.0 \cdot a_{M+1}=0.0}} \\
&= \frac{1+\sum_{i=1}^{M} a_i' z^{-i}}{1+\sum_{i=1}^{M+1} a_i'' z^{-i}}
\end{aligned}
$$

In equation 19, $a_i'$ holds the relationship of $a_i'=\gamma_1^i a_i$, and, consequently, above-described equation 16 and following equation 20 are equivalent to each other. That is, the inverse filter forming perceptual weighting filters 105-1 to 105-3 is equivalent to the inverse filter forming perceptual weighting filter 206.

(Equation 20)

$$
W(z) = 1 + \sum_{i=1}^{M} a_i (z/\gamma_1)^{-i} \quad [14]
$$

Further, a synthesis filter having the transfer function shown in above-described equation 17 in perceptual weighting filter 206 is equivalent to a filter having a cascade connection of the transfer functions shown in following equations 21 and 22 in perceptual weighting filters 105-1 to 105-3.

(Equation 21)

$$
W(z) = \frac{1}{1-\gamma_3 z^{-1}} \quad [15]
$$

(Equation 22)

$$
W(z) = \frac{1}{1+\sum_{i=1}^{M} a_i (z/\gamma_2)^{-i}} \quad [16]
$$

Here, the filter coefficients of the synthesis filter, which are represented by equation 17 in which the order is increased by one, are outputs of filtering of filter coefficients $\gamma_2^i a_i$ shown in equation 22 using a filter having the transfer function represented by $(1-\gamma_3 z^{-1})$, and are represented by $a_i''-\gamma_3^i a_{i-1}''$ when $a_i''=\gamma_2^i a_i$ is defined. Further, $a_0''=a_0$ and $a_{M+1}''=\gamma_2^{M+1} a^{M+1}=0.0$ are defined. Further, the relationship of $a_0=1.0$ holds.

Further, assume that an input and output of a filter having the transfer function shown in equation 22 are u(n) and v(n), respectively, an input and output of a filter having the transfer function shown in equation 21 are v(n) and w(n), respectively, and the result of developing these equations is equation 23.

(Equation 23)

$$\begin{cases} v(n) = u(n) - \sum_{i=1}^{M} a_i'' v(n-i) \\ w(n) = v(n) + \gamma_3 w(n-1) \end{cases} \quad [17]$$

$$\therefore w(n) - \gamma_3 w(n-1) = u(n) - \sum_{i=1}^{M} a_i'' (w(n-i) - \gamma_3 w(n-i-1))$$

$$\begin{aligned} \therefore w(n) &= u(n) + \gamma_3 w(n-1) - \sum_{i=1}^{M} a_i'' w(n-i) + \\ &\quad \gamma_3 \sum_{i=1}^{M} a_i'' w(n-i-1) \\ &= u(n) - \sum_{i=1}^{M} a_i'' w(n-i) + \gamma_3 \sum_{i=0}^{M} a_i'' w(n-i-1), \\ &\quad \text{where } (a_0'' = 0) \\ &= u(n) - \sum_{i=1}^{M} a_i'' w(n-i) + \gamma_3 \sum_{i=1}^{M+1} a_{i-1}'' w(n-1) \\ &= u(n) - \sum_{i=1}^{M} (a_i'' - \gamma_3 a_{i-1}'') w(n-i) \end{aligned}$$

$$\therefore H(z) = \frac{1}{1 + \sum_{i=1}^{M} (a_i'' - \gamma_3 a_{i-1}'') z^{-i}}$$

The result is also acquired from equation 23 that a filter combining synthesis filters having respective transfer functions represented by above equations 21 and 22 in perceptual weighting filters 105-1 to 105-3, is equivalent to a synthesis filter having the transfer function represented by above equation 17 in perceptual weighting filter 206.

As described above, although perceptual weighting filter 206 and perceptual weighting filters 105-1 to 105-3 are equivalent to each other, perceptual weighting filter 206 is formed with two filters having respective transfer functions represented by equations 16 and 17, and the number of filters is smaller by one than perceptual weighting filters 105-1 to 105-3 formed with three filters having respective transfer functions represented by equations 20, 21 and 22, so that it is possible to simplify processing. Further, for example, if two filters are combined to one, intermediate variables generated in two filter processing needs not be generated, whereby the filter state needs not be held upon generating the intermediate variables, so that updating the filter state becomes easier. Further, it is possible to prevent degradation of accuracy of computations caused by dividing filter processing into a plurality of phases and improve accuracy upon encoding. As a whole, the number of filters forming speech encoding apparatus 200 according to the present embodiment is six, and the number of filters forming speech encoding apparatus 100 shown in Embodiment 1 is eleven, and therefore the difference between these numbers is five.

As described above, according to the present embodiment, the number of filtering processing decreases, so that it is possible to adaptively adjust the spectral slope of quantization noise without changing formant weighting, and simplify speech encoding processing and prevent degradation of encoding performance caused by degradation of precision of computations.

Embodiment 3

Figure 7:
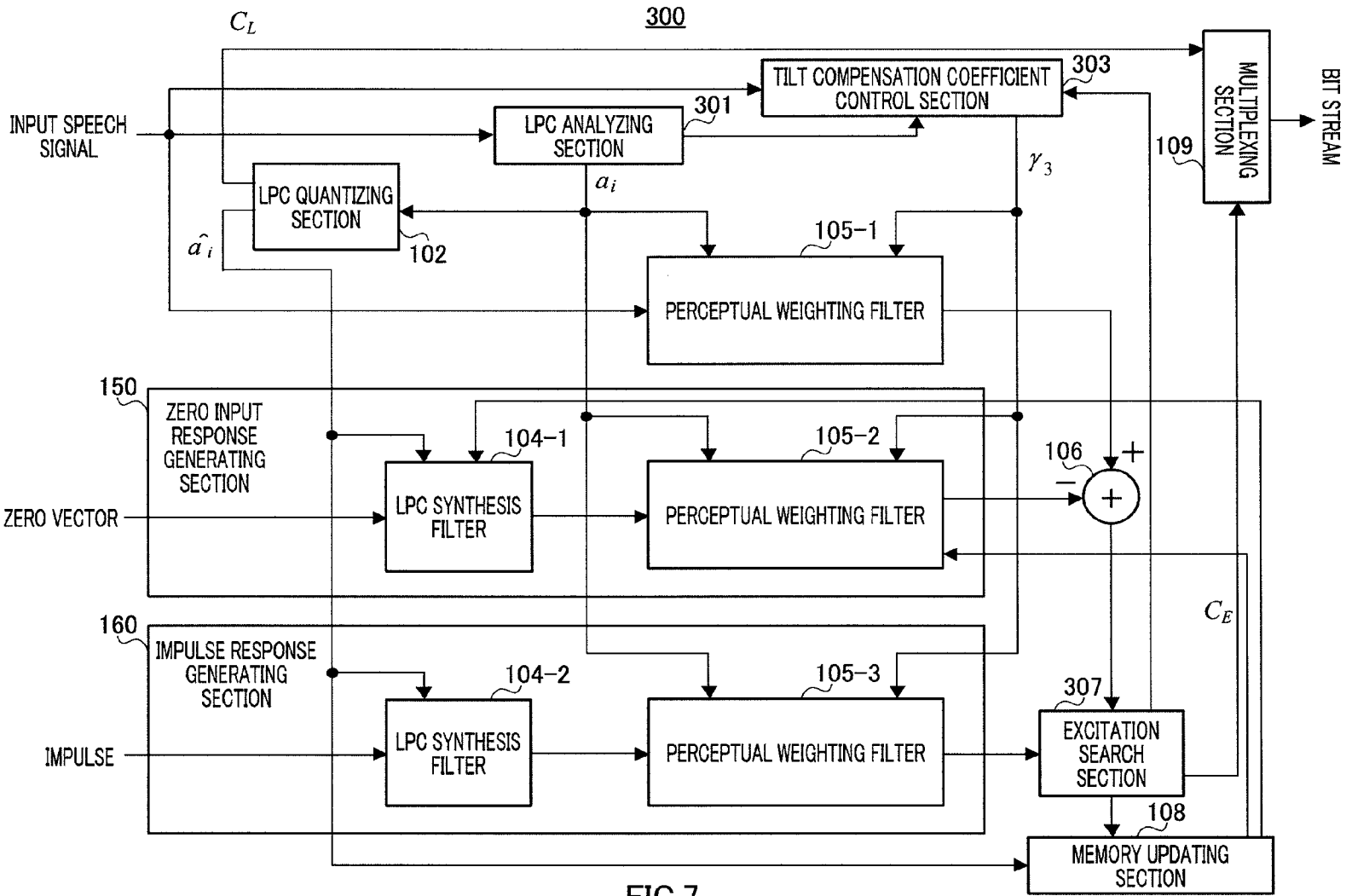
FIG. 7 is a block diagram showing the main components of a speech encoding apparatus according to Embodiment 3 of the present invention.

FIG. 7 is a block diagram showing the main components of speech encoding apparatus 300 according to Embodiment 3 of the present invention. Further, speech encoding apparatus 300 has the similar basic configuration to speech encoding apparatus 100 (see FIG. 1) shown in Embodiment 1, and the same components will be assigned the same reference numerals and explanations will be omitted. Further, there are differences between LPC analyzing section 301, tilt compensation coefficient control section 303 and excitation search section 307 of speech encoding apparatus 300 and LPC analyzing section 101, tilt compensation coefficient control section 103 and excitation search section 107 of speech encoding apparatus 100 in part of processing, and, to show the difference, a different reference numerals are assigned and only these sections will be explained below.

LPC analyzing section 301 differs from LPC analyzing section 101 shown in Embodiment 1 only in outputting the square mean value of linear prediction residue acquired in the process of linear prediction analysis with respect to an input speech signal, to tilt compensation coefficient control section 303.

Excitation search section 307 differs from excitation search section 107 shown in Embodiment 1 only in calculating a pitch prediction gain expressed by $|\Sigma x(n)y(n)|^2/(\Sigma x(n)x(n) \times \Sigma y(n)y(n))$, $n=0, 1, \ldots, L-1$, in the search process of an adaptive codebook, and outputting the pitch prediction gain to tilt compensation coefficient control section 303. Here, $x(n)$ is the target signal for an adaptive codebook search, that is, the target signal received as input from adder 106. Further, $y(n)$ is the signal superposing the impulse response signal of a perceptual weighting synthesis filter (which is a cascade connection filter formed with a perceptual weighting filter and synthesis filter), that is, the perceptual weighted impulse response signal received as input from perceptual weighting filter 105-3, over the excitation signal received as input from the adaptive codebook. Further, excitation search section 107 shown in Embodiment 1 also calculates two terms of $|\Sigma x(n)y(n)|^2$ and $\Sigma y(n)y(n)$, and, consequently, compared to excitation search section 107 shown in Embodiment 1, excitation search section 307 further calculates only the term of $\Sigma x(n)x(n)$ and finds the above-noted pitch prediction gain using these three terms.

Figure 8:
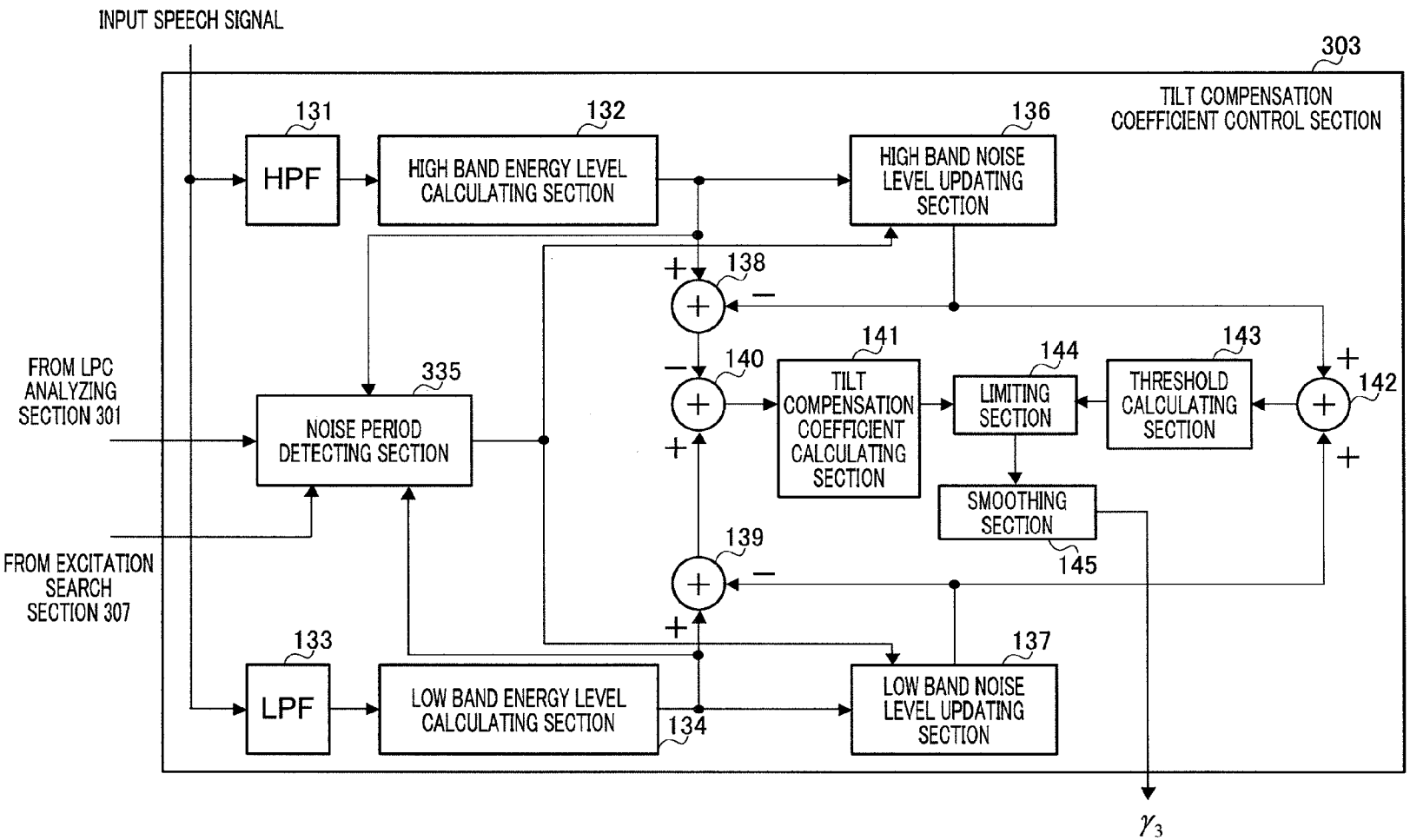
FIG. 8 is a block diagram showing the configuration inside a tilt compensation coefficient control section according to Embodiment 3 of the present invention.

FIG. 8 is a block diagram showing the configuration inside tilt compensation coefficient control section 303 according to Embodiment 3 of the present invention. Further, tilt compensation coefficient control section 303 has a similar configuration to tilt compensation coefficient control section 103 (see FIG. 2) shown in Embodiment 1, and the same components will be assigned the same reference numerals and explanations will be omitted.

There are differences between noise period detecting section 335 of tilt compensation coefficient control section 303 and noise period detecting section 135 of tilt compensation coefficient control section 103 shown in Embodiment 1 in part of processing, and, to show the differences, the different reference numerals are assigned. Noise period detecting section 335 does not receive as input a speech signal, and detects a noise period of an input speech signal on a per frame basis, using the square mean value of linear prediction residue received as input from LPC analyzing section 301, pitch prediction gain received as input from excitation search section 307, energy level of high band components of speech signal received as input from high band energy level calculating section 132 and energy level of low band components of speech signal received as input from low band energy level calculating section 134.

Figure 9:
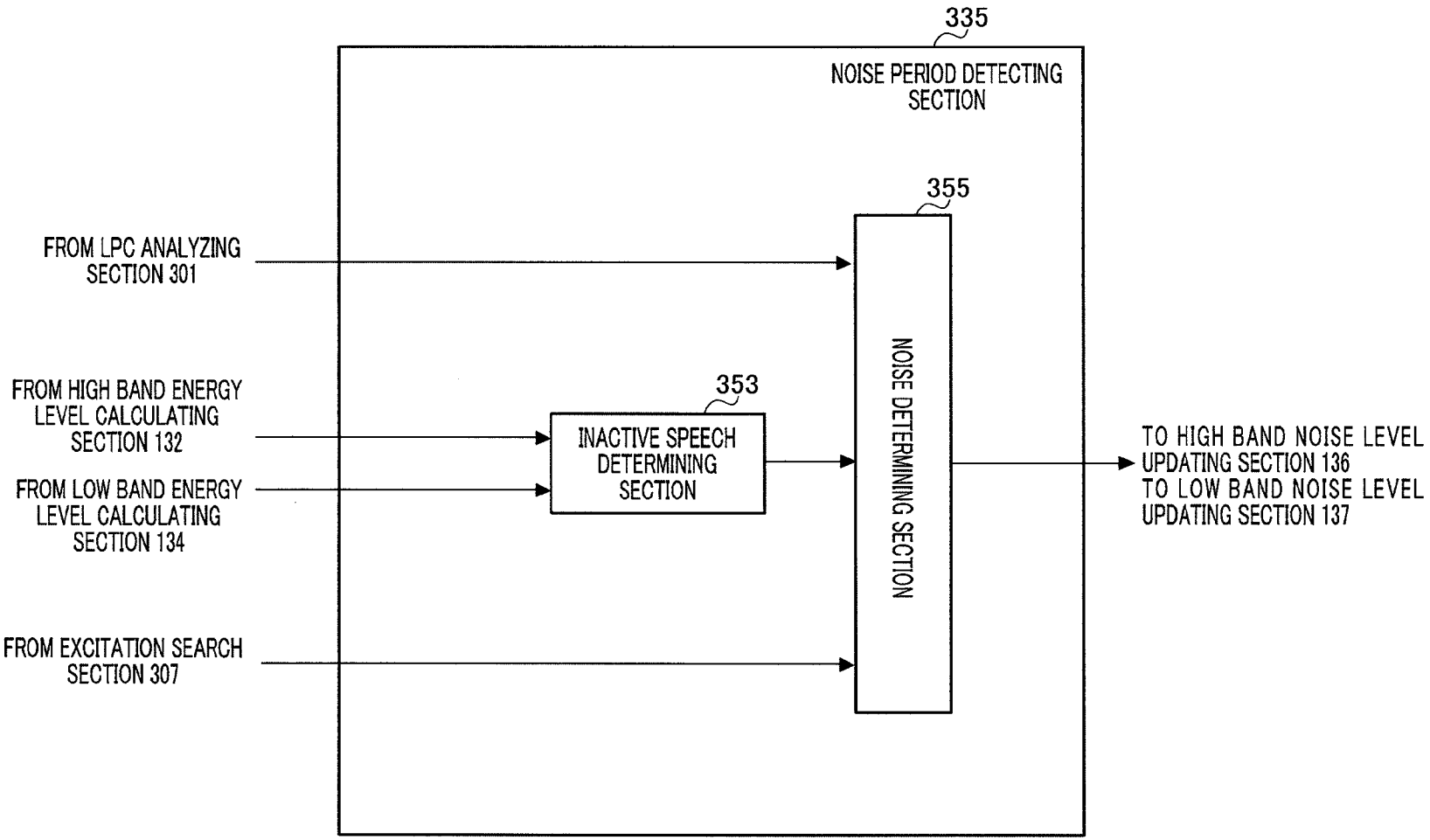
FIG. 9 is a block diagram showing the configuration inside a noise period detecting section according to Embodiment 3 of the present invention.

FIG. 9 is a block diagram showing the configuration inside noise period detecting section 335 according to Embodiment 3 of the present invention.

Inactive speech determining section 353 determines on a per frame basis whether an input speech signal is inactive speech or active speech, using the energy level of high band components of speech signal received as input from high band energy level calculating section 132 and energy level of low band components of speech signal received as input from low band energy level calculating section 134, and outputs the inactive speech determination result to noise determining section 355. For example, inactive speech determining section 353 determines that the input speech signal is inactive speech when the sum of the energy level of high band components of speech signal and energy level of low band components of speech signal is less than a predetermined threshold, and determines that the input speech signal is active speech when the above-noted sum is equal to or greater than the predetermined threshold. Here, as a threshold for the sum of the energy level of high band components of speech signal and energy level of low band components of speech signal, for example, $2\times10\log_{10}(32\times L)$, where L is the frame length, is used.

Noise determining section 355 determines on a per frame basis whether an input speech signal is a noise period or a speech period, using the square mean value of linear prediction residue received as input from linear analyzing section 301, inactive speech determination result received as input from inactive speech determining section 353 and pitch prediction gain received as input from excitation search section 307, and outputs the determination result as a noise period detection result to high band noise level updating section 136 and low band noise level updating section 137. To be more specific, when the square mean value of the linear prediction residue is less than a predetermined threshold and the pitch prediction gain is less than a predetermined threshold, or when the inactive speech determination result received as input from inactive speech determining section 353 shows an inactive speech period, noise determining section 355 determines that the input speech signal is a noise period, and, otherwise, determines that the input speech signal is a speech period. Here, for example, 0.1 is used as a threshold for the square mean value of linear prediction residue, and, for example, 0.4 is used as a threshold for the pitch prediction gain.

As described above, according to the present embodiment, noise period detection is performed using the square mean value of linear prediction residue and pitch prediction gain generated in the LPC analysis process in speech encoding and the energy level of high band components of speech signal and energy level of low band components of speech signal generated in the calculation process of a tilt compensation coefficient, so that it is possible to suppress the amount of calculations for noise period detection and perform spectral tilt compensation of quantization noise without increasing the overall amount of calculations in speech encoding.

Further, although an example case has been described above with the present embodiment where the Levinson Durbin algorithm is executed as a linear prediction analysis and the square mean value of linear prediction residue acquired in the process is used to detect a noise period, the present invention is not limited to this. As a linear prediction analysis, it is possible to execute the Levinson Durbin algorithm after normalizing the autocorrelation function of an input signal by the autocorrelation function maximum value, and the square mean value of linear prediction residue acquired in this process is a parameter showing a linear prediction gain and may be referred to as the normalized prediction residue power of the linear prediction analysis (here, the inverse number of the normalized prediction residue power corresponds to a linear prediction gain).

Further, the pitch prediction gain according to the present embodiment may be referred to as normalized cross-correlation.

Further, although an example case has been described above with the present embodiment where values calculated on a per frame basis as square mean values of linear prediction residue and pitch prediction gain are used as is, the present invention is not limited to this, and, to find a more reliable detection result in a noise period, it is possible to use square mean values of the linear prediction residue and pitch prediction gain smoothed between frames.

Further, although an example case has been described above with the present embodiment where high band energy level calculating section 132 and low band energy level calculating section 134 calculate the energy level of high band components of speech signal and energy level of low band components of speech signal according to equations 5 and 6, respectively, the present invention is not limited to this, and it is possible to further add bias such as $4\times2\times L$ (where L is the frame length) such that the calculated energy level is not made a value close to zero. In this case, high band noise level updating section 136 and low band noise level updating section 137 use the energy level of high band components of speech signal and energy level of low band components of speech signal with bias as above. By this means, in adders 138 and 139, it is possible to find a reliable SNR of clean speech data without background noise.

Embodiment 4

The speech encoding apparatus according to Embodiment 4 of the present invention has the same components as in speech encoding apparatus 300 according to Embodiment 3 of the present invention and perform the same basic operations, and therefore will not be shown and detailed explanations will be omitted. However, there are differences between tilt compensation coefficient control section 403 of the speech encoding apparatus according to the present embodiment and tilt compensation coefficient control section 303 of speech encoding apparatus 300 according to Embodiment 3 in part of processing, and the different reference numeral is assigned to show the differences. Only tilt compensation coefficient control section 403 will be explained below.

Figure 10:
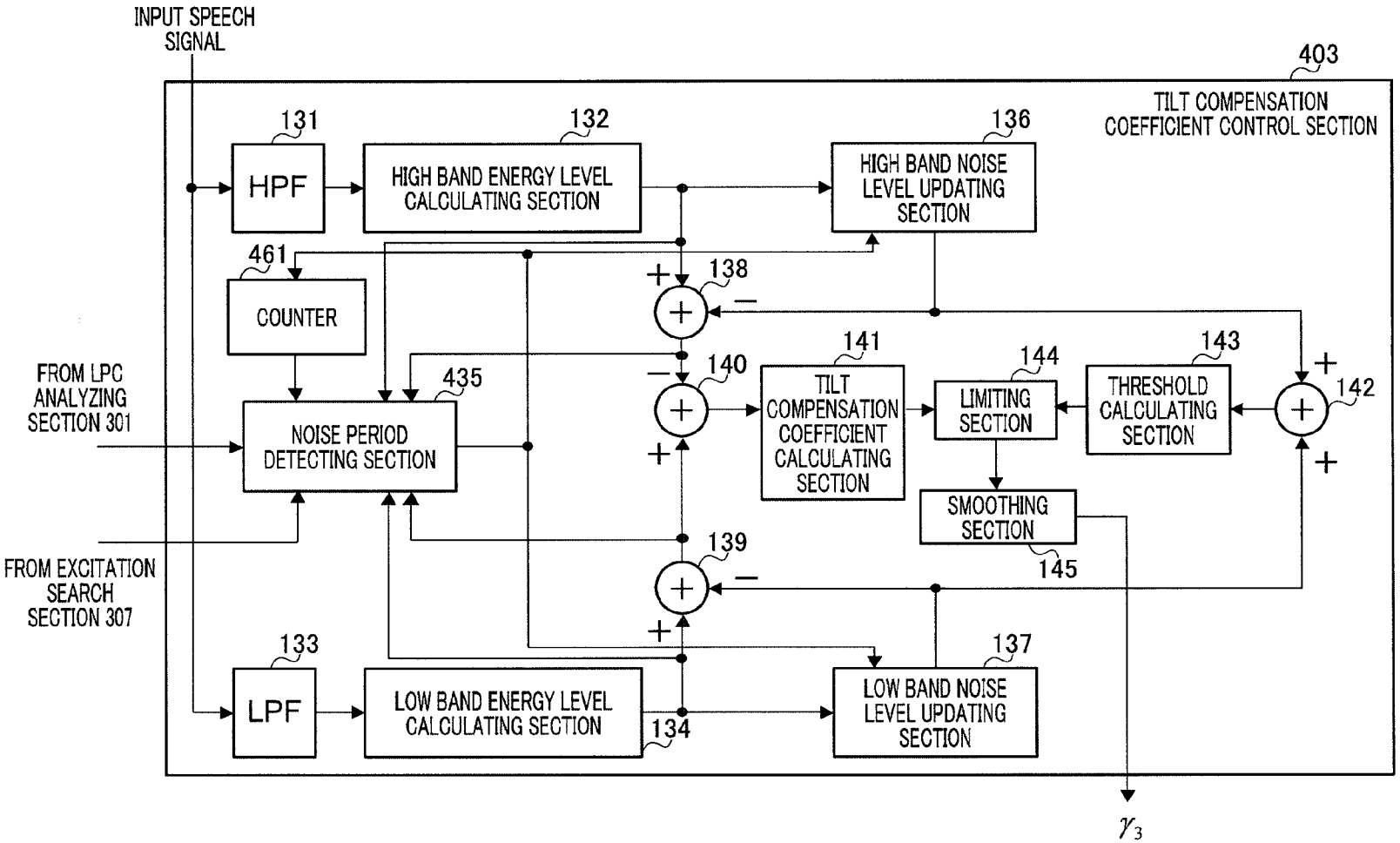
FIG. 10 is a block diagram showing the configuration inside a tilt compensation coefficient control section according to Embodiment 4 of the present invention.

FIG. 10 is a block diagram showing the configuration inside tilt compensation coefficient control section 403 according to Embodiment 4 of the present invention. Further, tilt compensation coefficient control section 403 has the similar basic configuration to tilt compensation coefficient control section 303 (see FIG. 8) shown in Embodiment 3, and differs from tilt compensation coefficient control section 303 in providing counter 461. Further, there are differences between noise period detecting section 435 of tilt compensation coefficient control section 403 and noise period detecting section 335 of tilt compensation coefficient control section 303 in receiving as input a high band SNR and low band SNR from adders 138 and 139, respectively, and in part of processing, and the different reference numerals are assigned to show the differences.

Counter 461 is formed with the first counter and second counter, and updates the values on the first counter and second counter using noise period detection results received as input from noise period detecting section 435 and feeds back the updated values on the first counter and second counter to noise period detecting section 435. To be more specific, the first counter counts the number of frames determined consecutively as noise periods, and the second counter counts the number of frames determined consecutively as speech periods. When a noise period detection result received as input from noise period detecting section 435 shows a noise period, the first counter is incremented by one and the second counter is reset to zero. By contrast, when a noise period detection result received as input from noise period detecting section 435 shows a speech period, the second counter is incremented by one. That is, the first counter shows the number of frames determined as noise periods in the past, and the second counter shows how many frames have been successively determined as speech periods.

Figure 11:
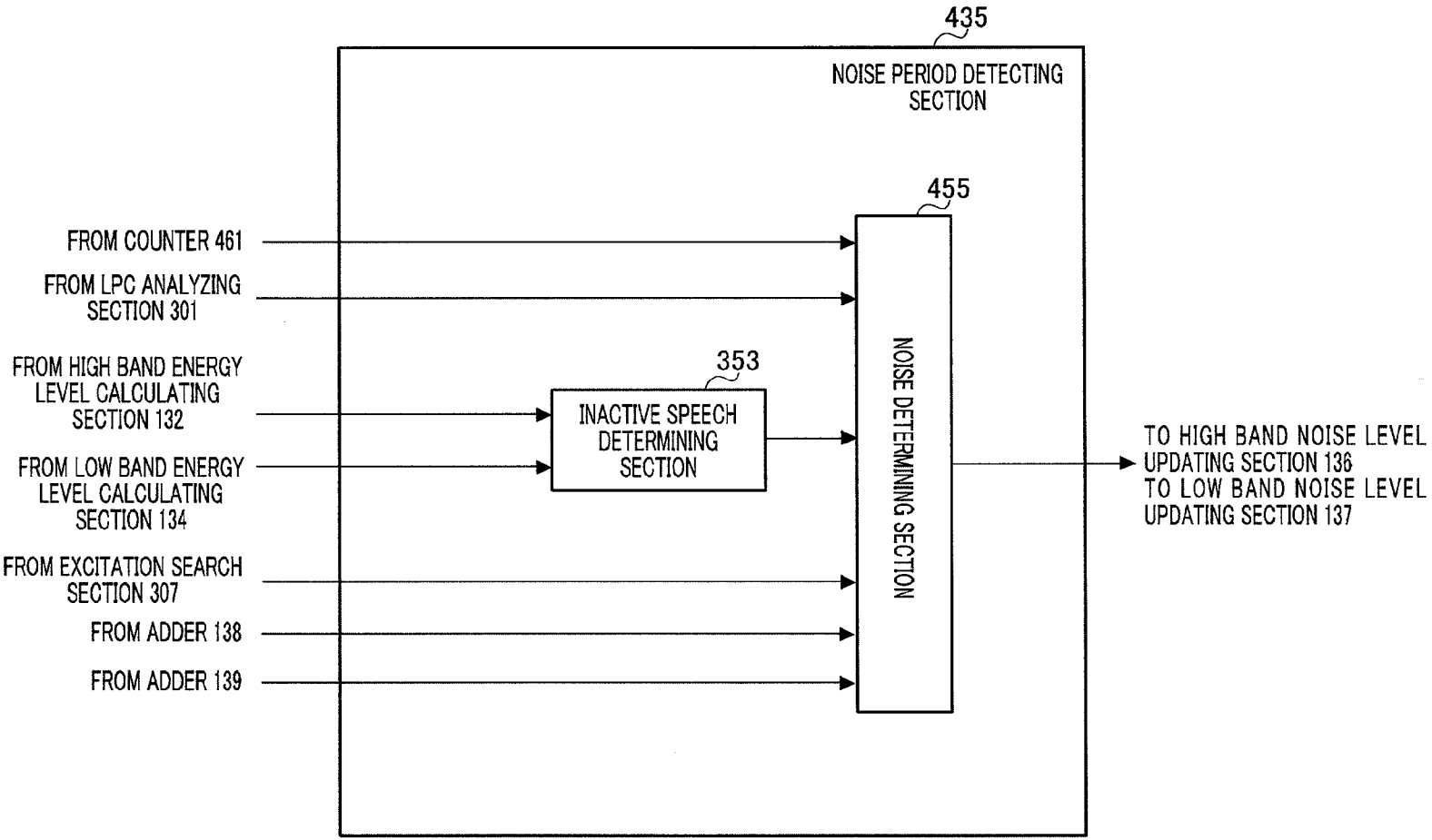
FIG. 11 is a block diagram showing the configuration inside a noise period detecting section according to Embodiment 4 of the present invention.

FIG. 11 is a block diagram showing the configuration inside noise period detecting section 435 according to Embodiment 4 of the present invention. Further, noise period detecting section 435 has the similar basic configuration to noise period detecting section 335 (see FIG. 9) shown in Embodiment 3 and performs the same basic operations. However, there are differences between noise determining section 455 of noise period detecting section 435 and noise determining section 355 of noise period detecting section 335 in part of processing, and the different reference numerals are assigned to show the differences.

Noise determining section 455 determines on a per frame basis whether an input speech signal is a noise period or a speech period, using the values on the first counter and second counter received as input from counter 461, square mean value of linear prediction residue received as input from LPC analyzing section 301, inactive speech determination result received as input from inactive speech determining section 353, the pitch prediction gain received as input from excitation search section 307 and high band SNR and low band SNR received as input from adders 138 and 139, and outputs the determination result as a noise period detection result, to high band noise level updating section 136 and low band noise level updating section 137. To be more specific, in one of cases where the square mean value of linear prediction residue is less than a predetermined threshold and the pitch prediction gain is less than a predetermined threshold and where an inactive speech determination result shows an inactive speech period, and, in one of cases where the value on the first counter is less than a predetermine threshold, where the value on the second counter is equal to or greater than a predetermined threshold and where both the high band SNR and the low band SNR are less than a predetermined threshold, noise determining section 455 determines that the input speech signal is a noise period, and otherwise determines that the input speech signal is a speech period. Here, for example, 100 is used as a threshold for the value on the first counter, for example, 10 is used as a threshold for the value on the second counter, and, for example, 5 dB is used as a threshold for the high band SNR and low band SNR.

That is, even when the conditions to determine a encoding target frame as a noise period in noise determining section 355 shown in Embodiment 3 are met, if the value on the first counter is equal to or greater than a threshold, the value on the second counter is less than a threshold and at least one of the high band SNR and the low band SNR is equal to or greater than a predetermined threshold, noise determining section 455 determines that the input speech signal is not in a noise period but is a speech period. As a reason for this, there is a high possibility that meaningful speech signals are present in addition to background noise in a frame of a high SNR, and, consequently, the frame needs not be determined as a noise period. However, unless the number of frames determined as a noise period in the past is equal to or greater than a predetermined number, that is, unless the value on the first counter is equal to or greater than a predetermined threshold, assume that accuracy of the SNR is low. Therefore, if the value on the first counter is less than a predetermined threshold even when the above-noted SNR is high, noise determining section 455 performs a determination only by a determination reference in noise determining section 355 shown in Embodiment 3, and does not use the above-noted SNR for a noise period determination. Further, although the noise period determination using the above-noted SNR is effective to detect onset of speech, if this determination is used frequently, the period that should be determined as noise may be determined as a speech period. Therefore, in an onset period of speech, namely, immediately after a noise period switches to a speech period, that is, when the value on the second counter is less than a predetermined threshold, it is preferable to limit the use of noise period determination. By this means, it is possible to prevent an onset period of speech from being determined as a noise period by mistake.

As described above, according to the present embodiment, a noise period is detected using the number of frames determined consecutively as a noise period or speech period in the past and the high band SNR and low band SNR of a speech signal, so that it is possible to improve the accuracy of noise period detection and improve the accuracy of spectral tilt compensation for quantization noise.

Embodiment 5

In Embodiment 5 of the present invention, a speech encoding method will be explained for adjusting the spectral slope of quantization noise and performing adaptive perceptual weighting filtering suitable for a noise-speech superposition period in which background signals and speech signals are superposed on one another, in AMR-WB (adaptive multirate-wideband) speech encoding.

Figure 12:
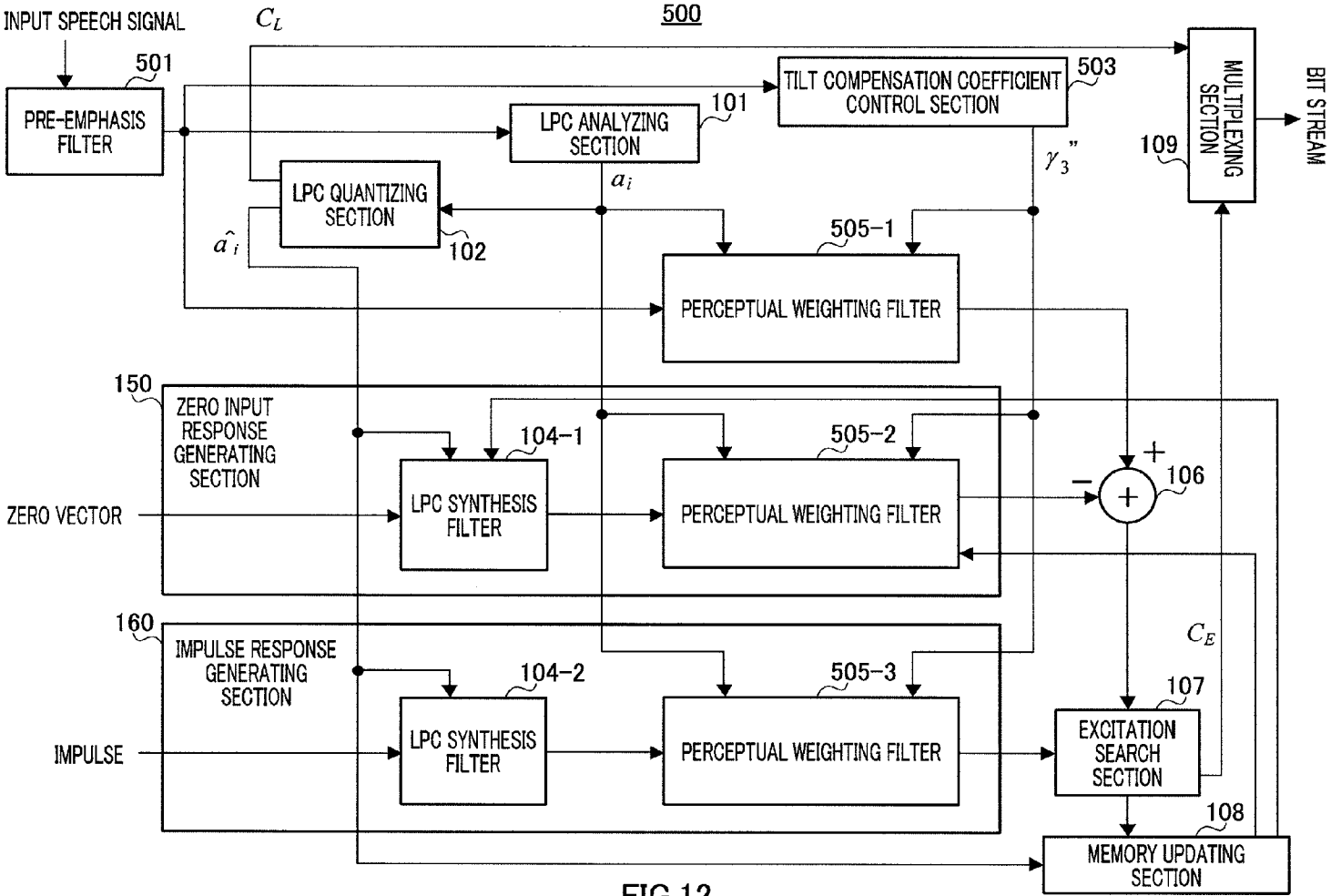
FIG. 12 is a block diagram showing the main components of a speech encoding apparatus according to Embodiment 5 of the present invention.

FIG. 12 is a block diagram showing the main components of speech encoding apparatus 500 according to Embodiment 5 of the present invention. Speech encoding apparatus 500 shown in FIG. 12 is equivalent to an AMR-WB encoding apparatus adopting an example of the present invention. Further, speech encoding apparatus 500 has a similar configuration to speech encoding apparatus 100 (see FIG. 1) shown in Embodiment 1, and the same components will be assigned the same reference numerals and explanations will be omitted.

Speech encoding apparatus 500 differs from speech encoding apparatus 100 shown in Embodiment 1 in further having pre-emphasis filter 501. Further, there are differences between tilt compensation coefficient control section 503 and perceptual weighting filters 505-1 to 505-3 of speech encoding apparatus 500 and tilt compensation coefficient control section 103 and perceptual weighting filters 105-1 to 105-3 of speech encoding apparatus 100 in part of processing, and, consequently, the different reference numerals are assigned to show the differences. Only these differences will be explained below.

Pre-emphasis filter 501 performs filtering with respect to an input speech signal using the transfer function expressed by $P(z)=1-\gamma_2 z^{-1}$ and outputs the result to LPC analyzing section 101, tilt compensation coefficient control section 503 and perceptual weighting filter 505-1.

Tilt compensation coefficient control section 503 calculates tilt compensation coefficient $\gamma_3''$ for adjusting the spectral slope of quantization noise using the input speech signal subjected to filtering in pre-emphasis filter 501, and outputs the tilt compensation coefficient $\gamma_3''$ to perceptual weighting filters 505-1 to 505-3. Further, tilt compensation coefficient control section 503 will be described later in detail.

Perceptual weighting filters 505-1 to 505-3 are different from perceptual weighting filters 105-1 to 105-3 shown in Embodiment 1 only in performing perceptual weighting filtering with respect to the input speech signal subjected to filtering in pre-emphasis filter 501, using the transfer function shown in following equation 24 including the linear prediction coefficients $a_i$ received as input from LPC analyzing section 101 and tilt compensation coefficient $\gamma_3''$ received as input from tilt compensation coefficient control section 503.

(Equation 24)

$$\frac{1+\sum_{i=1}^{M} a_i(z/\gamma_1)^{-i}}{1-\gamma_3'' z^{-1}} \quad [18]$$

Figure 13:
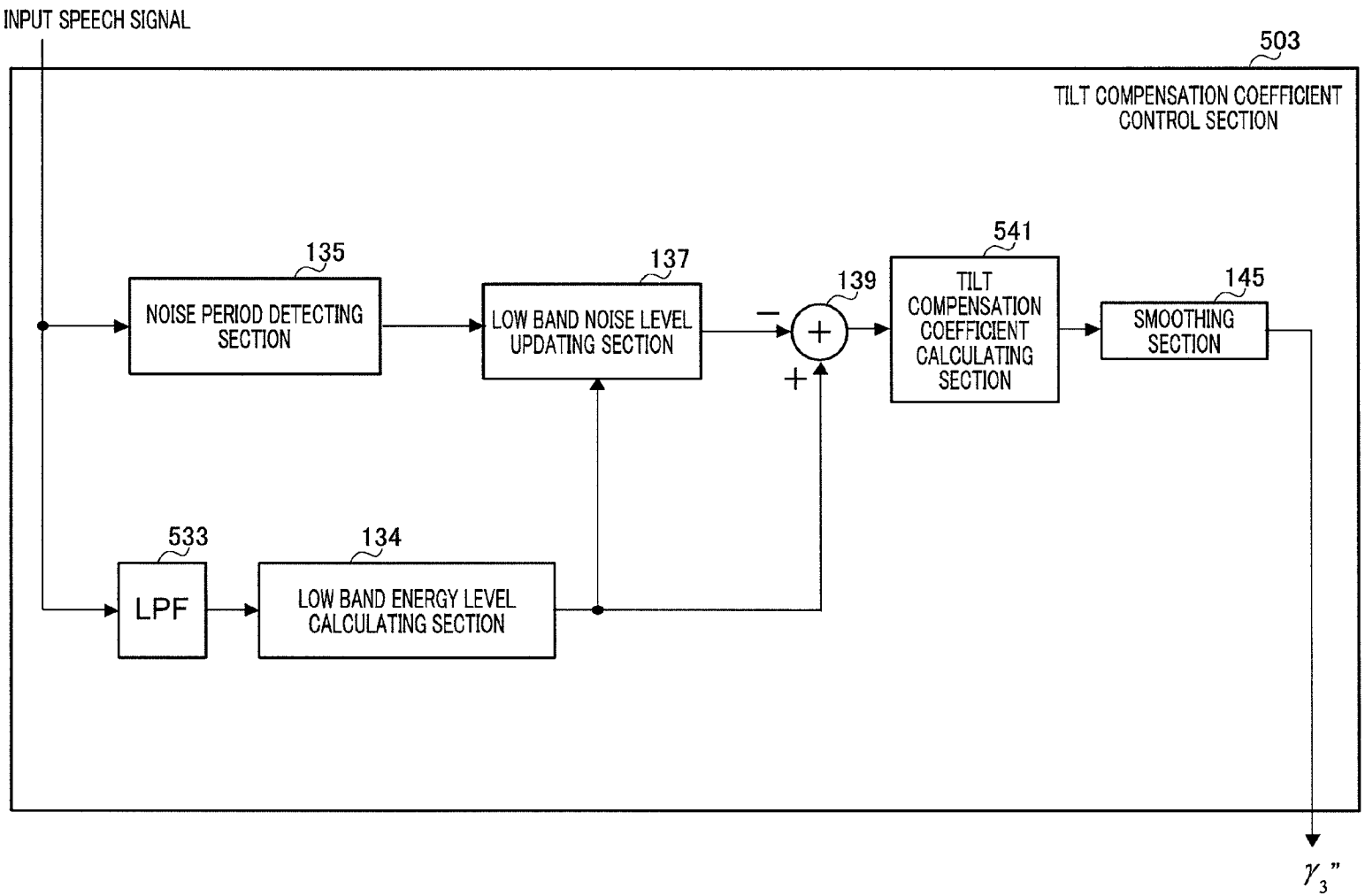
FIG. 13 is a block diagram showing the configuration inside a tilt compensation coefficient control section according to Embodiment 5 of the present invention.

FIG. 13 is a block diagram showing the configuration inside tilt compensation coefficient control section 503. Low band energy level calculating section 134, noise period detecting section 135, low band noise level updating section 137, adder 139 and smoothing section 145 provided by tilt compensation coefficient control section 503 are equivalent to low band energy level calculating section 134, noise period detecting section 135, low band noise level updating section 137, adder 139 and smoothing section 145 provided by tilt compensation coefficient control section 103 (see FIG. 1) shown in Embodiment 1, and therefore explanations will be omitted. Further, there are differences between LPF 533, tilt compensation coefficient calculating section 541 of tilt compensation coefficient control section 503 and LPF 133, tilt compensation coefficient calculating section 141 of tilt compensation coefficient control section 103 in part of processing, and, consequently, the different reference numerals are assigned to show the differences and only these differences will be explained. Further, not to make the following explanations complicated, the tilt compensation coefficient before smoothing calculated in tilt compensation coefficient calculating section 541 and the tilt compensation coefficient outputted from smoothing section 145 will not be distinguished, and will be explained as a tilt compensation coefficient $\gamma_3$."

LPF 533 extracts low band components less than 1 kHz in the frequency domain of an input speech signal subjected to filtering in pre-emphasis filter 503, and outputs the low band components of speech signal to low band energy level calculating section 134.

Figure 14:
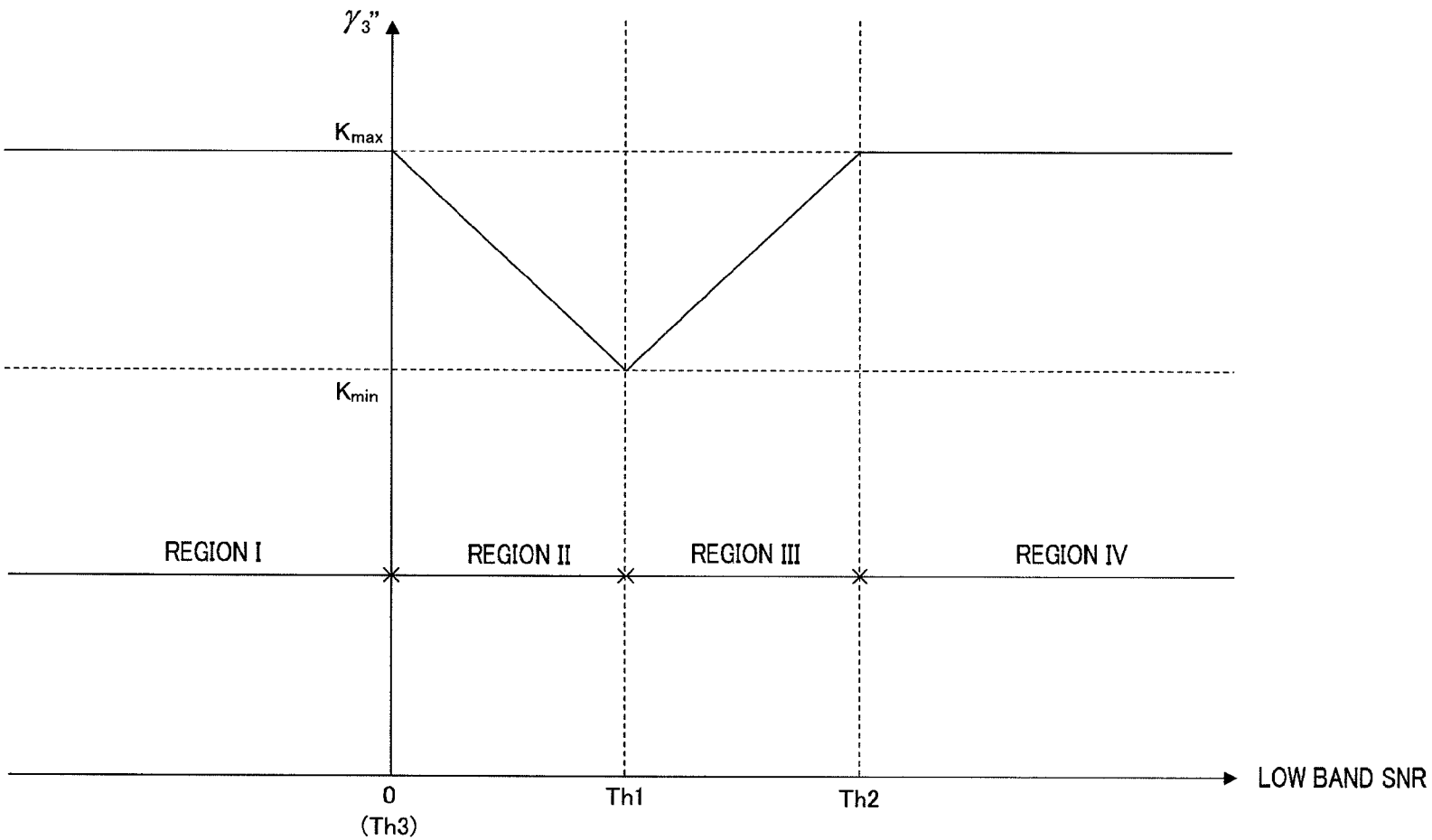
FIG. 14 illustrates a calculation of tilt compensation coefficients in a tilt compensation coefficient calculating section according to Embodiment 5 of the present invention.

Tilt compensation coefficient calculating section 541 calculates the tilt compensation coefficient $\gamma_3''$ as shown in FIG. 14, and outputs the tilt compensation coefficient $\gamma_3''$ to smoothing section 145.

FIG. 14 illustrates a calculation of the tilt compensation coefficient $\gamma_3''$ in tilt compensation coefficient calculating section 541.

As shown in FIG. 14, when the low band SNR is less than 0 dB (i.e., in region I), or when the low band SNR is equal to or greater than Th2 dB (i.e., in region IV), tilt compensation coefficient calculating section 541 outputs $K_{max}$ as $\gamma_3''$. Further, tilt compensation coefficient calculating section 541 calculates $\gamma_3''$ according to following equation 25 when the low band SNR is equal to or greater than 0 and less than Th1 (i.e., in region II), and calculates $\gamma_3'$ according to following equation 26 when the low band SNR is equal to or greater than Th1 and less than Th2 (i.e., in region III).

$$\gamma_3''=K_{max}-S(K_{max}-K_{min})/Th1 \quad \text{(Equation 25)}$$

$$\gamma_3''=K_{min}-Th1(K_{max}-K_{min})/(Th2-Th1)+S(K_{max}-K_{min})/(Th2-Th1) \quad \text{(Equation 26)}$$

In equations 25 and 26, if speech encoding apparatus 500 is not provided with tilt compensation coefficient control section 503, $K_{max}$ is the value of constant tilt compensation coefficient $\gamma_3''$ used in perceptual weighting filters 505-1 to 505-3. Further, $K_{min}$ and $K_{max}$ are constants holding $0<K_{min}<K_{max}<1$.

In FIG. 14, region I shows a period in which only background noise is present without speech in an input speech signal, region II shows a period in which background noise is predominant over speech in an input speech signal, region III shows a period in which speech is predominant over background noise in an input speech signal, and region IV shows a period in which only speech is present without background noise in an input speech signal. As shown in FIG. 14, if the low band SNR is equal to or greater than Th1 (i.e., in regions III and IV), tilt compensation coefficient calculating section 541 makes the value of tilt compensation coefficient $\gamma_3''$ larger in the range between $K_{min}$ and $K_{max}$ when the low band SNR increases. Further, as shown in FIG. 14, when the low band SNR is less than Th1 (i.e., in region I and region II), tilt compensation coefficient calculating section 541 makes the value of tilt compensation coefficient $\gamma_3''$ larger in the range between $K_{min}$ and $K_{max}$ when the low band SNR decreases. The reason is that, when the low band SNR is low in some extent (i.e., in region I and region II), a background signal is predominant, that is, a background signal itself is the target to be listened, and that, in this case, noise shaping which collects quantization noise in low frequencies should be avoided.

Figure 15A:
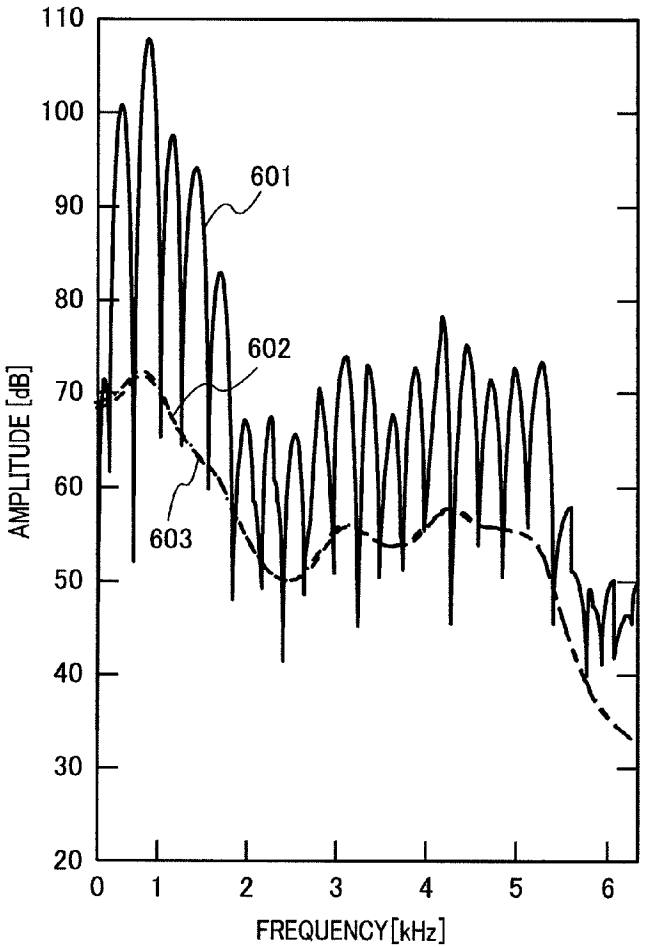
FIG. 15 illustrates an effect acquired by shaping quantization noise using a speech encoding apparatus according to Embodiment 5 of the present invention.
Figure 15B:
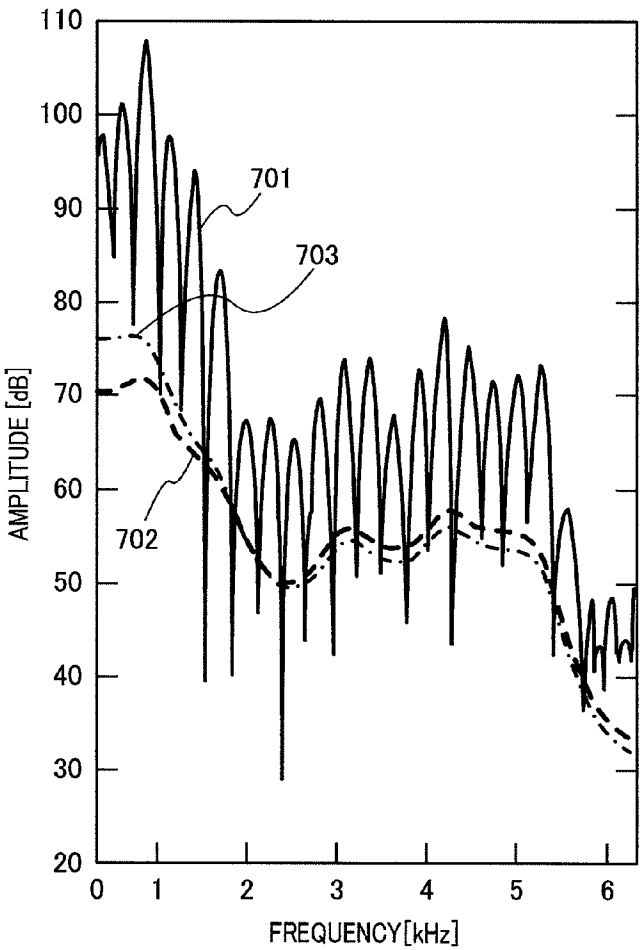

FIG. 15A and FIG. 15B illustrate an effect acquired by shaping quantization noise using speech encoding apparatus 500 according to the present embodiment. Here, these figures illustrate the spectrum of the vowel part in the sound of "SO" as in "SOUCHOU," pronounced by a woman. Although these figures illustrate spectrums in the same period of the same signal, a background noise (car noise) is added in FIG. 15B. FIG. 15A illustrates an effect acquired by shaping quantization noise with respect to a speech signal in which there is only speech and there is substantially no background noise, that is, with respect to a speech signal of the low band SNR associated with region IV of FIG. 14. Further, FIG. 15B illustrates an effect acquired upon shaping quantization noise with respect to a speech signal in which background noise (referred to as "car noise") and speech are superposed on one another, that is, with respect to a speech signal of the low band SNR associated with region II or region III in FIG. 14.

In FIG. 15A and FIG. 15B, solid lines graphs 601 and 701 show spectrum examples of speech signals in the same speech period that are different only in an existence or non-existence of background noise. Dotted line graphs 602 and 702 show quantization noise spectrums acquired upon shaping quantization noise using speech encoding apparatus 500 without tilt compensation coefficient control section 503. Dashed line graphs 603 and 703 show quantization noise spectrums acquired upon shaping quantization noise using speech encoding apparatus 500 according to the present embodiment.

As known from a comparison between FIG. 15A and FIG. 15B, when tilt compensation of quantization noise is performed, graphs 603 and 703 showing quantized error spectrum envelopes differ from each other, depending on whether background noise is present.

Further, as shown in FIG. 15A, graphs 602 and 603 are substantially the same. The reason is that, in region IV shown in FIG. 14, tilt compensation coefficient calculating section 541 outputs $K_{max}$ as $\gamma_3''$ to perceptual weighting filters 505-1 to 505-3. Further, as described above, if speech encoding apparatus 500 is not provided with tilt compensation coefficient control section 503, $K_{max}$ is the value of constant tilt compensation coefficient $\gamma_3''$ used in perceptual weighting filters 505-1 to 505-3.

Further, the characteristics of a car noise signal includes that the energy is concentrated at low frequencies and the low band SNR decreases. Here, assume that the low band SNR of speech signal shown in graph 701 in FIG. 15B corresponds to region II and region III shown in FIG. 14. In this case, tilt compensation coefficient calculating section 541 calculates the tilt compensation coefficient $\gamma_3$," which is a smaller value than $K_{max}$. By this means, the quantized error spectrum is as represented by graph 703 that increases in the lower band.

As described above, according to the present embodiment, when a speech signal is predominant while the background noise level in low frequencies is high, the slope of the perceptual weighting filter is controlled to further allow low band quantization noise. By this means, quantization is possible which places an emphasis on high band components, so that it is possible to improve subjective quality of a quantized speech signal.

Furthermore, according to the present embodiment, if the low band SNR is less than a predetermined threshold, the tilt compensation coefficient $\gamma_3''$ is further increased when the low band SNR is lower, and, if the low band SNR is equal to or greater than a threshold, the tilt compensation coefficient $\gamma_3''$ is further increased when the low band SNR is higher. That is, a control method of the tilt compensation coefficient $\gamma_3''$ is switched according to whether a background noise or a speech signal is predominant, so that it is possible to adjust the spectral slope of quantization noise such that noise shaping suitable for a predominant signal amongst signals included in an input signal is possible.

Further, although an example case has been described above with the present embodiment where tilt compensation coefficient $\gamma_3''$ shown in FIG. 14 is calculated in tilt compensation coefficient calculating section 541, the present invention is not limited to this, and it is equally possible to calculate the tilt compensation coefficient $\gamma_3''$ according to the equation $\gamma_3''=\beta\times$low band SNR+C. Further, in this case, a limit of the upper limit value and lower limit value is provided with respect to the calculated tilt compensation coefficient $\gamma_3''$. For example, if speech encoding apparatus 500 is not provided with tilt compensation coefficient control section 503, it is possible to use the value of constant tilt compensation coefficient $\gamma_3''$ used in perceptual weighting filters 505-1 to 505-3, as the upper limit value.

Embodiment 6

Figure 16:
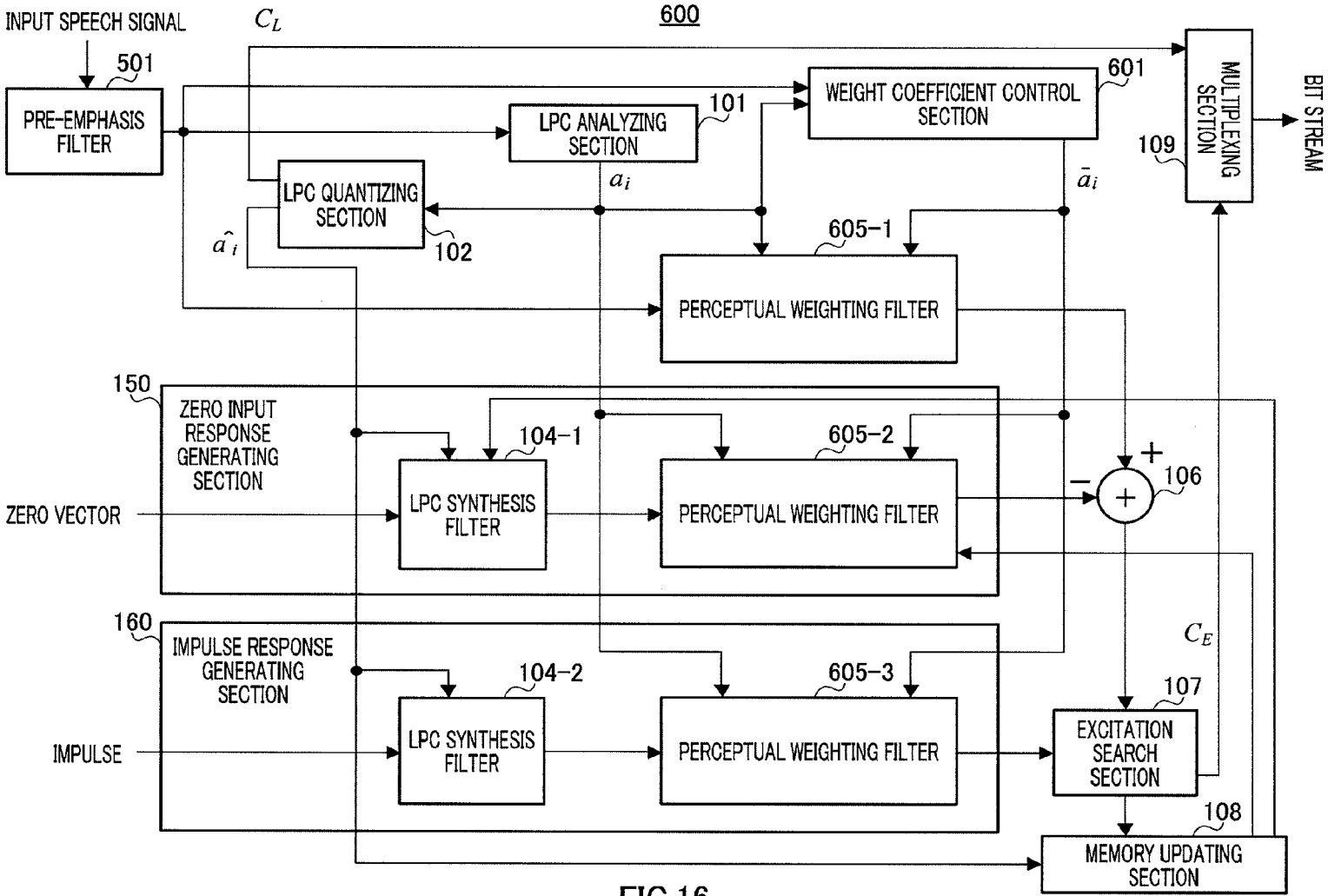
FIG. 16 is a block diagram showing the main components of a speech encoding apparatus according to Embodiment 6 of the present invention.

FIG. 16 is a block diagram showing the main components of speech encoding apparatus 600 according to Embodiment 6 of the present embodiment. Speech encoding apparatus 600 shown in FIG. 16 has a similar configuration to speech encoding apparatus 500 (see FIG. 12) shown in Embodiment 5, and the same components will be assigned the same reference numerals and explanations will be omitted.

Speech encoding apparatus 600 is different from speech encoding apparatus 500 shown in Embodiment 5 in providing weight coefficient control section 601 instead of tilt compensation coefficient control section 503. Further, there are differences between perceptual weighting filters 605-1 to 605-3 of speech encoding apparatus 600 and perceptual weighting filters 505-1 to 505-3 of speech encoding apparatus 500 in part of processing, and, consequently, the different reference numerals are assigned. Only these differences will be explained below.

Weight coefficient control section 601 calculates a weight coefficient $a^{-}_i$ using an input speech signal after filtering in pre-emphasis filter 501, and outputs the $a^{-}_i$ to perceptual weighting filters 605-1 to 605-3. Further, weight coefficient control section 601 will be described later in detail.

Perceptual weighting filters 605-1 to 605-3 are different from perceptual weighting filters 505-1 to 505-3 shown in Embodiment 5 only in performing perceptual weighing filtering with respect to the input speech signal after filtering in pre-emphasis filter 501, using the transfer function shown in following equation 27 including constant tilt compensation coefficient $\gamma_3''$, linear prediction coefficients $a_i$ received as input from LPC analyzing section 101 and weight coefficients $a^{-}_i$ received as input from weight coefficient control section 601.

(Equation 27)

$$w(z) = \frac{1+\sum_{i=1}^{M} a_i(z/\gamma_1)^{-i}}{1-\gamma_3'' z^{-1}}\left(1+\sum_{i=1}^{M}\bar{a}_i z^{-i}\right) \quad [19]$$

Figure 17:
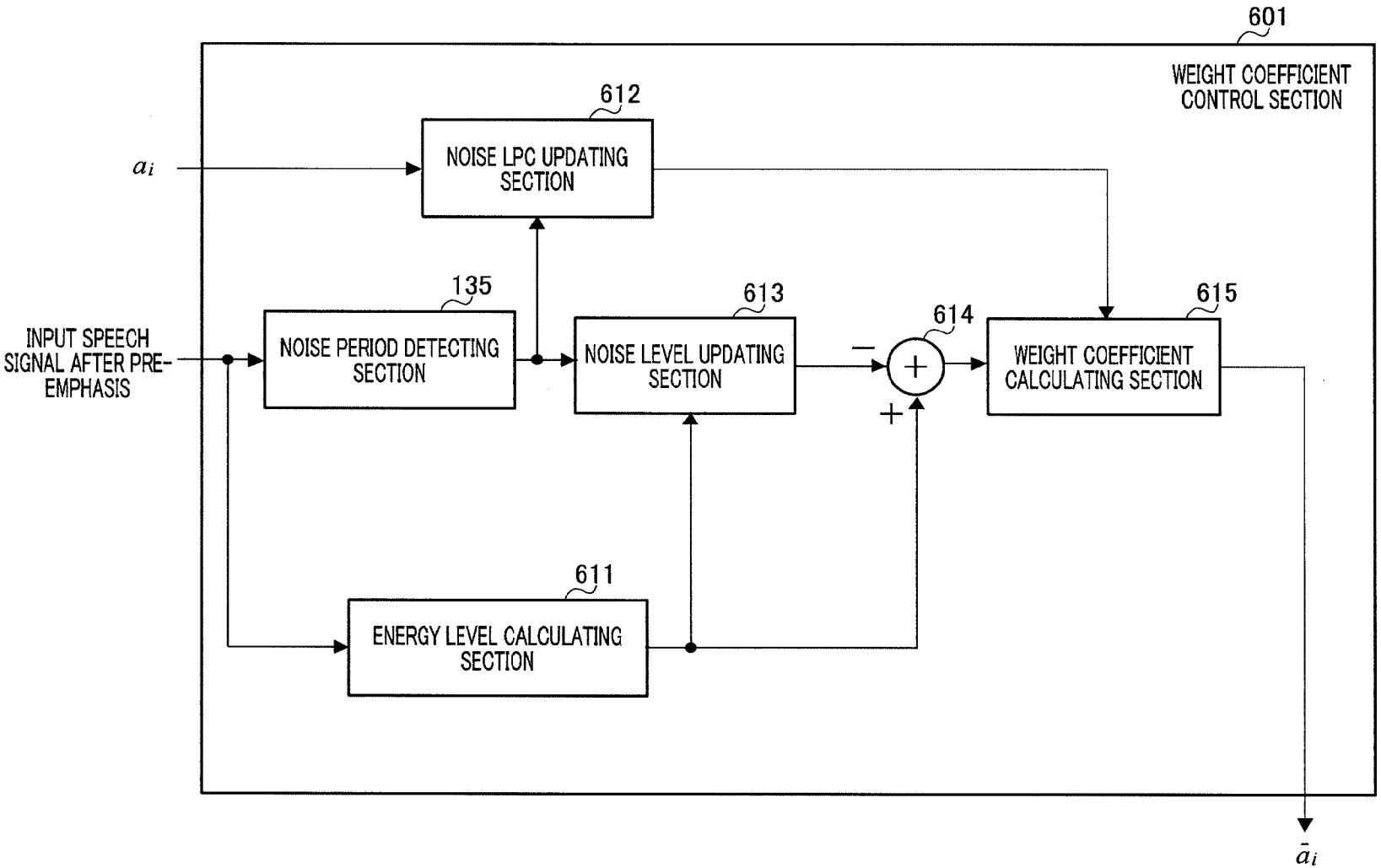
FIG. 17 is a block diagram showing the configuration inside a weight coefficient control section according to Embodiment 6 of the present invention.

FIG. 17 is a block diagram showing the configuration inside weight coefficient control section 601 according to the present embodiment.

In FIG. 17, weight coefficient control section 601 is provided with noise period detecting section 135, energy level calculating section 611, noise LPC updating section 612, noise level updating section 613, adder 614 and weight coefficient calculating section 615. Here, noise period detecting section 135 is equivalent to noise period detecting section 135 of tilt compensation coefficient calculating section 103 (see FIG. 2) shown in Embodiment 1.

Energy level calculating section 611 calculates the energy level of the input speech signal after pre-emphasis in pre-emphasis filter 501 on a per frame basis, according to following equation 28, and outputs the speech signal energy level to noise level updating section 613 and adder 614.

$$E=10\log_{10}(|A|^2) \quad \text{(Equation 28)}$$

In equation 28, A represents the input speech signal vector (vector length=frame length) after pre-emphasis in pre-emphasis filter 501. That is, $|A|^2$ is the frame energy of the speech signal. E is a decibel representation of $|A|^2$ and is the speech signal energy level.

Noise LPC updating section 612 finds the average value of linear prediction coefficients $a_i$ in noise periods received as input from LPC analyzing section 101, based on the noise period determining result in noise period detecting section 135. To be more specific, linear prediction coefficients $a_i$ received as input are converted into LSF (Line Spectral Frequency) or ISF (Immittance Spectral Frequency), which are frequency domain parameters, and the average value of LSF or ISF in noise periods is calculated and outputted to weight coefficient calculating section 615. A method of calculating the average value of LSF or ISF can be updated every time by using equations such as Fave=βFave+(1−β) F. Here, Fave is the average values of ISF or LSF in noise periods, β is the smoothing coefficient, F is the ISF or LSF in frames (or subframes) determined as noise periods (i.e., ISF or LSF acquired by converting linear prediction coefficients $a_i$ received as input). Further, when linear prediction coefficients are converted to LSF or ISF in LPC quantizing section 102, let LSF or ISF is received as input from LPC quantizing section 102 to weight coefficient control section 601, noise LPC updating section 612 needs not perform processing for converting linear prediction coefficients $a_i$ to ISF or LSF.

Noise level updating section 613 holds the average energy level of background noise, and, upon receiving as input background noise period detection information from noise period detecting section 135, updates the average energy level of background noise held using the speech signal energy level received as input from energy level calculating section 611. As a method of updating, updating is performed according to, for example, following equation 29.

$$E_N=\alpha E_N+(1-\alpha)E \quad \text{(Equation 29)}$$

In equation 29, E represents the speech signal energy level received as input from energy level calculating section 611. When background noise period detection information is received as input from noise period detecting section 135 to noise level updating section 613, it shows that the input speech signal is comprised of only background noise periods, and the speech signal energy level received as input from energy level calculating section 611 to noise level updating section 613, that is, E shown in the above-noted equation is the background noise energy level. $E_N$ represents the average energy level of background noise held in noise level updating section 613 and $\alpha$ is the long term smoothing coefficient where $0 \leqq \alpha < 1$. Noise level updating section 613 outputs the average energy level of background noise held to adder 614.

Adder 614 subtracts the average energy level of background noise received as input from noise level updating section 613, from the speech signal energy level received as input from energy level calculating section 611, and outputs the subtraction result to weight coefficient calculating section 615. The subtraction result acquired in adder 614 shows the difference between two energy levels represented by logarithm, that is, the subtraction result shows the difference between the speech signal energy level and the average energy level of background noise. Consequently, the subtraction result shows a ratio of these two energies, that is, a ratio between the speech signal energy and the long term average energy of background noise signal. In other words, the subtraction result acquired in adder 614 is the speech signal SNR.

Weight coefficient calculating section 615 calculates a weight coefficient $a^-_i$ using the SNR received as input from adder 614 and the average ISF or LSF in noise periods received as input from noise LPC updating section 612, and outputs the weight coefficient $a^-_i$ to perceptual weighting filters 605-1 to 605-3. To be more specific, first, weight coefficient calculating section 615 acquires $S^-$ by performing short term smoothing of the SNR received as input from adder 614, and further acquires $L^-_i$ by performing short term smoothing of the average ISF or LSF in noise periods received as input from noise LPC updating section 612. Next, weight coefficient calculating section 615 acquires $b_i$ by converting $L^-_i$ into the LPC (linear prediction coefficients) in the time domain. Next, weight coefficient calculating section 615 calculates the weight adjustment coefficient $\gamma$ from $S^-$ as shown in FIG. 18 and outputs weight coefficient $a^-_i=\gamma^i b_i$.

Figure 18:
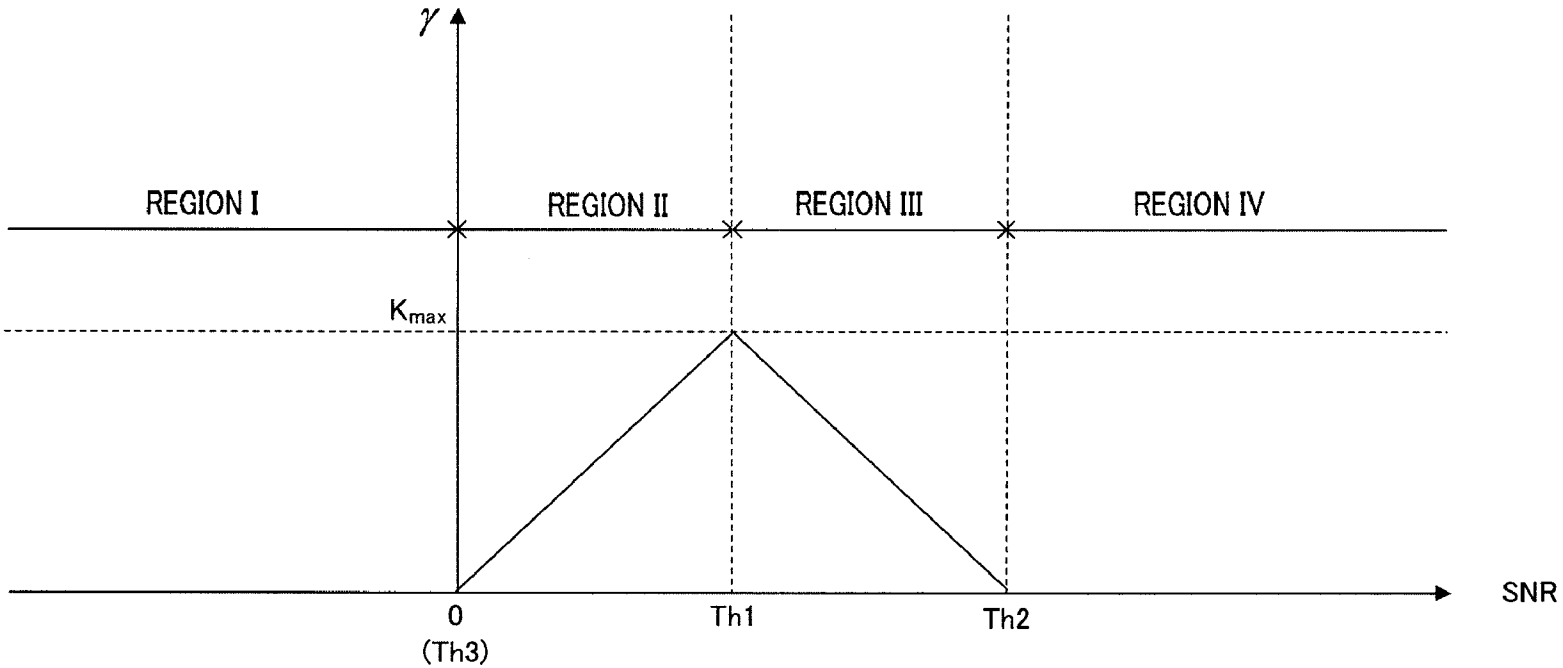
FIG. 18 illustrates a calculation of a weight adjustment coefficient in a weight coefficient calculating section according to Embodiment 6 of the present invention.

FIG. 18 illustrates a calculation of weight adjustment coefficient $\gamma$ in weight coefficient calculating section 615.

In FIG. 18, the definition of each region is the same as in FIG. 14. As shown in FIG. 18, weight coefficient calculating section 615 makes the value of weight adjustment coefficient $\gamma$ "0" in region I and region IV. That is, in region I and region IV, the linear prediction inverse filter represented by following equation 30 is in the off state in perceptual weighting filters 605-1 to 605-3.

(Equation 30)

$$\left(1+\sum_{i=1}^{M}\bar{a}_i z^{-i}\right) \quad [20]$$

Further, in region II and region III shown in FIG. 18, weight coefficient calculating section 615 calculates a weight adjustment coefficient $\gamma$ according to following equations 31 and 32.

$$\gamma=SK_{max}/Th1 \quad \text{(Equation 31)}$$

$$\gamma=K_{max}-K_{max}(S-Th1)/(Th2-Th1) \quad \text{(Equation 32)}$$

That is, as shown in FIG. 18, if the speech signal SNR is equal to or greater than Th1, weight coefficient calculating section 615 makes the weight adjustment coefficient $\gamma$ larger when the SNR increases, and, if the speech signal SNR is less than TH1, makes the weight adjustment coefficient $\gamma$ smaller when the SNR decreases. Further, the weight coefficient $a^-_i$ multiplying a linear prediction coefficient (LPC)$b_i$ showing the average spectrum characteristic in noise periods of the speech signal by the weight adjustment coefficient $\gamma^i$, is outputted to perceptual weighting filters 605-1 to 605-3 to form a linear prediction inverse filter.

As described above, according to the present embodiment, a weight coefficient is calculated by multiplying a linear prediction coefficient showing the average spectrum characteristic in noise periods of an input signal by a weight adjustment coefficient associated with the SNR of the speech signal, and the linear prediction inverse filter in a perceptual weighting filter is formed using this weight coefficient, so that it is possible to adjust the spectral envelope of quantization noise according to the spectrum characteristic of the input signal and improve sound quality of decoded speech.

Further, although a case has been described with the present embodiment where tilt compensation coefficient $\gamma_3$" used in perceptual weighting filters 605-1 to 605-3 is a constant, the present invention is not limited to this, and it is equally possible to further provide tilt compensation coefficient control section 503 shown in Embodiment 5 to speech encoding apparatus 600 and adjust the value of tilt compensation coefficient $\gamma_3$."

Embodiment 7

The speech encoding apparatus (not shown) according to Embodiment 7 of the present invention has a basic configuration similar to speech encoding apparatus 500 shown in Embodiment 5, and is different from speech encoding apparatus 500 only in the configuration and processing operations inside tilt compensation coefficient control section 503.

Figure 19:
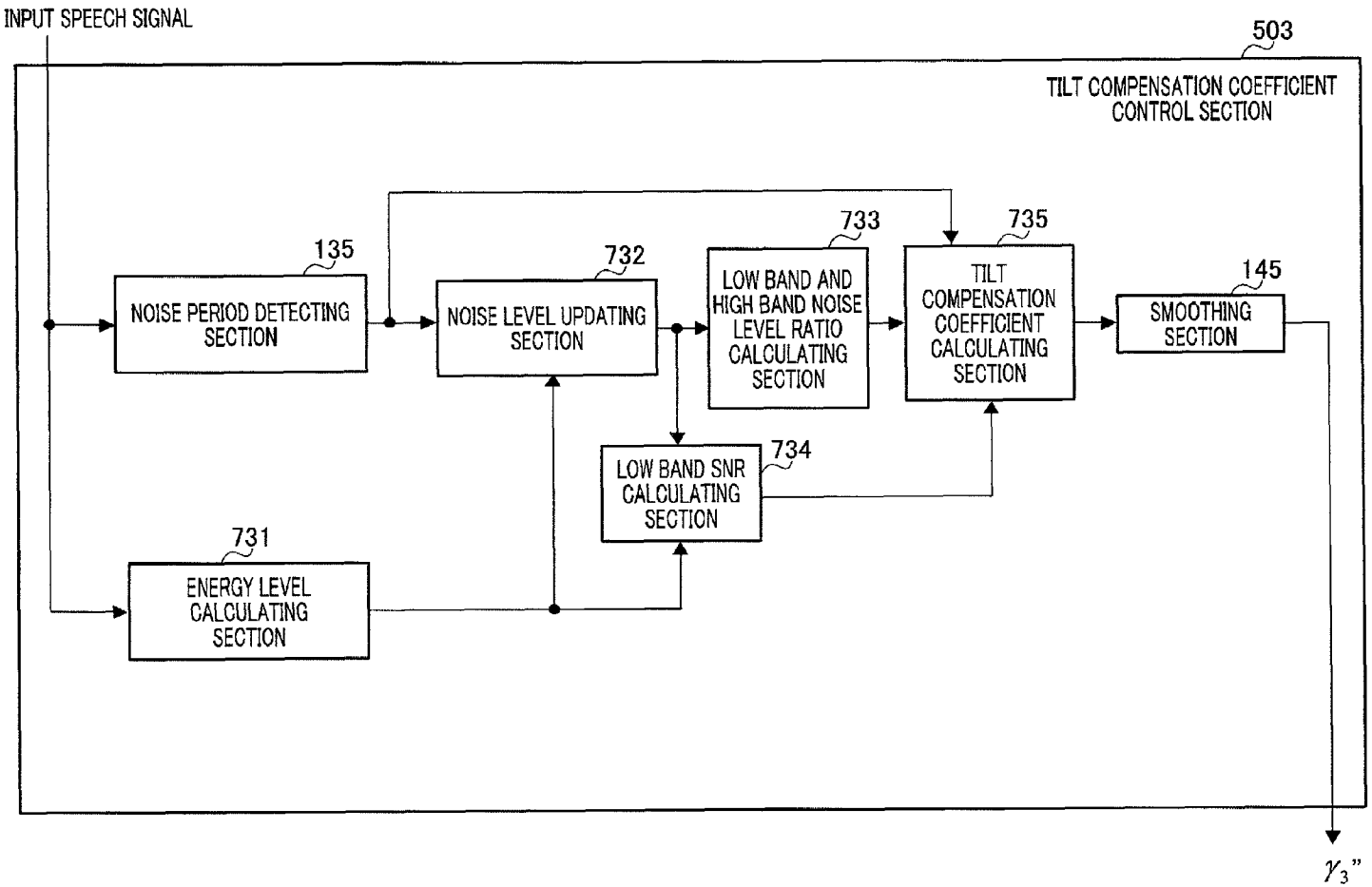
FIG. 19 is a block diagram showing the configuration inside a tilt compensation coefficient control section according to Embodiment 7 of the present invention.

FIG. 19 is a block diagram showing the configuration inside tilt compensation coefficient control section 503 according to Embodiment 7.

In FIG. 19, tilt compensation coefficient control section 503 is provided with noise period detecting section 135, energy level calculating section 731, noise level updating section 732, low band and high band noise level ratio calculating section 733, low band SNR calculating section 734, tilt compensation coefficient calculating section 735 and smoothing section 145. Here, noise period detecting section 135 and smoothing section 145 are equivalent to noise period detecting section 135 and smoothing section 145 provided by tilt compensation coefficient control section 503 according to Embodiment 5.

Energy level calculating section 731 calculates the energy level of an input speech signal after filtering in pre-emphasis filter 501 in more than two frequency bands, and outputs the calculated energy levels to noise level updating section 732 and low band SNR calculating section 734. To be more specific, energy level calculating section 731 calculates, on a per frequency band basis, the energy level of the input speech signal converted into a frequency domain signal using DFT (Discrete Fourier Transform), FFT (Fast Fourier Transform) and such. A case will be explained below where two frequency bands of low band and high band are used as an example of two or more frequency bands. Here, the low band is a band between 0 and 500 Hz to 1000 Hz, and the high band is a band between around 3500 Hz and around 6500 Hz.

Noise level updating section 732 holds the average energy level of background noise in the low band and average energy level of background noise in the high band. Upon receiving as input background noise period detection information from noise period detecting section 135, noise level updating section 732 updates the held average energy level of background noise in the low band and high band according to above-noted equation 29, using the speech signal energy level in the low band and high band received as input from energy level calculating section 731. However, noise level updating section 732 performs processing in the low band and high band according to equation 29. That is, when noise level updating section 732 updates the average energy of background noise in the low band, E in equation 29 represents the speech signal energy level in the low band received as input from energy level calculating section 731 and $E_N$ represents the average energy level of background noise in the low band held in noise level updating section 732. On the other hand, when noise level updating section 732 updates the average energy of background noise in the high band, E in equation 29 represents the speech signal energy level in the high band received as input from energy level calculating section 731 and $E_N$ represents the average energy level of background noise in the high band held in noise level updating section 732. Noise level updating section 732 outputs the updated average energy level of background noise in the low band and high band to low band and high band noise level ratio calculating section 733, and outputs the updated average energy level of background noise in the low band to low band SNR calculating section 734.

Low band and high band noise level ratio calculating section 733 calculates a ratio in dB units between the average energy level of background noise in the low band and average energy level of background noise in the high band received as input from noise level updating section 732, and outputs the result as a low band and high band noise level ratio to tilt compensation coefficient calculating section 735.

Low band SNR calculating section 734 calculates a ratio in dB units between the low band energy level of the input speech signal received as input from energy level calculating section 731 and the low band energy level of the background noise received as input from noise level updating section 732, and outputs the ratio as the low band SNR to tilt compensation coefficient calculating section 735.

Tilt compensation coefficient calculating section 735 calculates tilt compensation coefficient $\gamma_3''$ using the noise period detection information received as input from noise period detecting section 135, low band and high band noise level ratio received as input from low band and high band noise level ratio calculating section 733 and low band SNR received as input from low band SNR calculating section 734, and outputs the tilt compensation coefficient $\gamma_3''$ to smoothing section 145.

Figure 20:
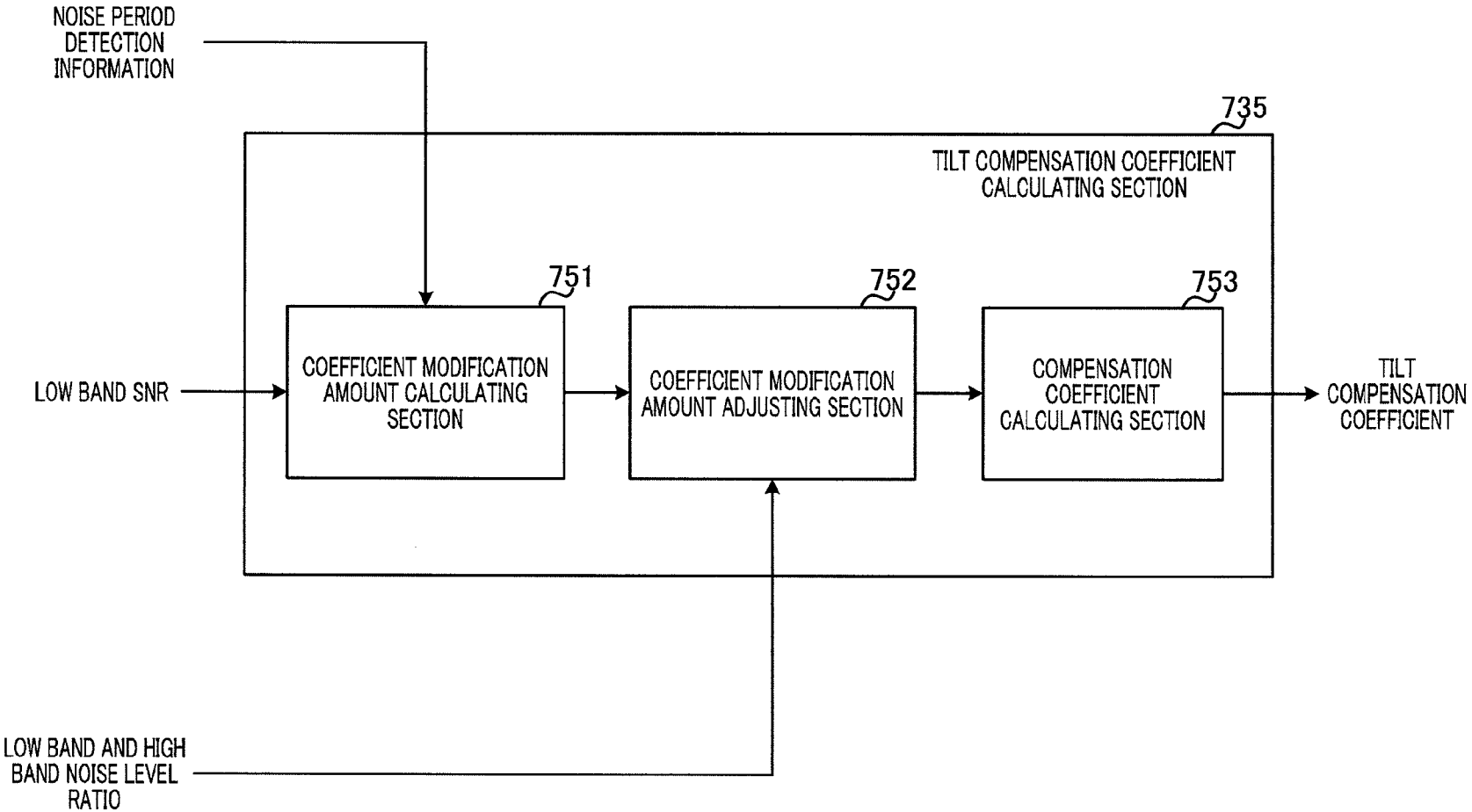
FIG. 20 is a block diagram showing the configuration inside a tilt compensation coefficient calculating section according to Embodiment 7 of the present invention.

FIG. 20 is a block diagram showing the configuration inside tilt compensation coefficient calculating section 735.

In FIG. 20, tilt compensation coefficient calculating section 735 is provided with coefficient modification amount calculating section 751, coefficient modification amount adjusting section 752 and compensation coefficient calculating section 753.

Figure 21:
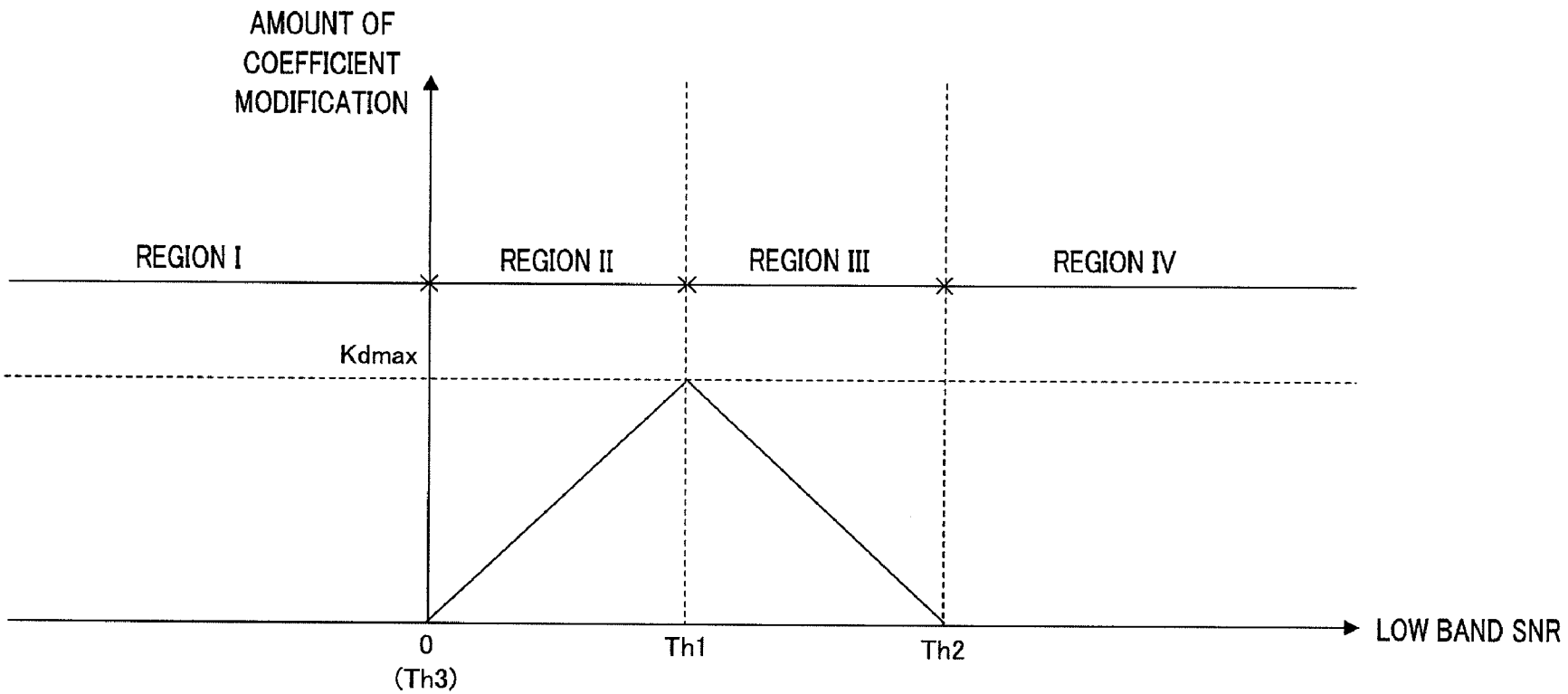
FIG. 21 illustrates a relationship between low band SNRs and a coefficient correction amount according to Embodiment 7 of the present invention.

Coefficient modification amount calculating section 751 calculates the amount of coefficient modification, which represents a modification degree of a tilt compensation coefficient, using the low band SNR received as input from low band SNR calculating section 734, and outputs the calculated amount of coefficient modification to coefficient modification amount adjusting section 752. Here, the relationship between the low band SNR received as input and the amount of coefficient modification to be calculated is shown in, for example, FIG. 21. FIG. 21 is equivalent to a figure acquired by seeing the horizontal axis in FIG. 18 as the low band SNR, seeing the vertical axis in FIG. 18 as the amount of coefficient modification and replacing the maximum value Kmax of weight coefficient γ in FIG. 18 with the maximum value Kdmax in the amount of coefficient modification. Further, upon receiving as input noise period detection information from noise period detecting section 135, coefficient modification amount calculating section 751 calculates the amount of coefficient modification as zero. By making the amount of coefficient modification in a noise period zero, inadequate modification of a tilt compensation coefficient in the noise period is prevented.

Coefficient modification amount adjusting section 752 further adjusts the amount of coefficient modification received as input from coefficient modification amount calculating section 751 using the low band and high band level ratio received as input from low band and high band noise level ratio calculating section 733. To be more specific, coefficient modification amount adjusting section 752 performs adjustment such that the amount of coefficient modification becomes smaller when the low band and high band noise level ratio decreases, that is, when the low band noise level becomes smaller than the high band noise level.

$$D2=\lambda\times Nd\times D1\,(0\leqq\lambda\times Nd\leqq 1) \qquad \text{(Equation 33)}$$

In equation 33, D1 represents the amount of coefficient modification received as input from coefficient modification amount calculating section 751 and D2 represents the amount of coefficient modification adjusted. Nd represents the low band and high band noise level ratio received as input from low band and high band noise level ratio calculating section 733. Further, λ is an adjustment coefficient by which Nd is multiplied and is, for example, λ=1/25=0.04. In the cases where λ is 1/25=0.04, Nd is greater than 25 and λ×Nd is greater than 1, coefficient correction amount adjusting section 752 clips λ×Nd to "1" as shown in λ×Nd=1. Further, similarly, in the cases where Nd is equal to or less than 0 and λ×Nd is equal to or less than 0, coefficient modification amount adjusting section 752 clips λ×Nd to "0" as shown in λ×Nd=0.

Compensation coefficient calculating section 753 compensates the default tilt compensation coefficient using the amount of coefficient modification received as input from coefficient modification amount adjusting section 752, and outputs the resulting tilt compensation coefficient $\gamma_3''$ to smoothing section 145. For example, compensation coefficient calculating section 753 calculates $\gamma_3''$ by $\gamma_3''$=Kdefault−D2. Here, Kdefault represents the default tilt compensation coefficient. The default tilt compensation coefficient represents a constant tilt compensation coefficient used in perceptual weighting filters 505-1 to 505-3 even if the speech encoding apparatus according to the present embodiment is not provided with tilt compensation coefficient control section 503.

Figure 22:
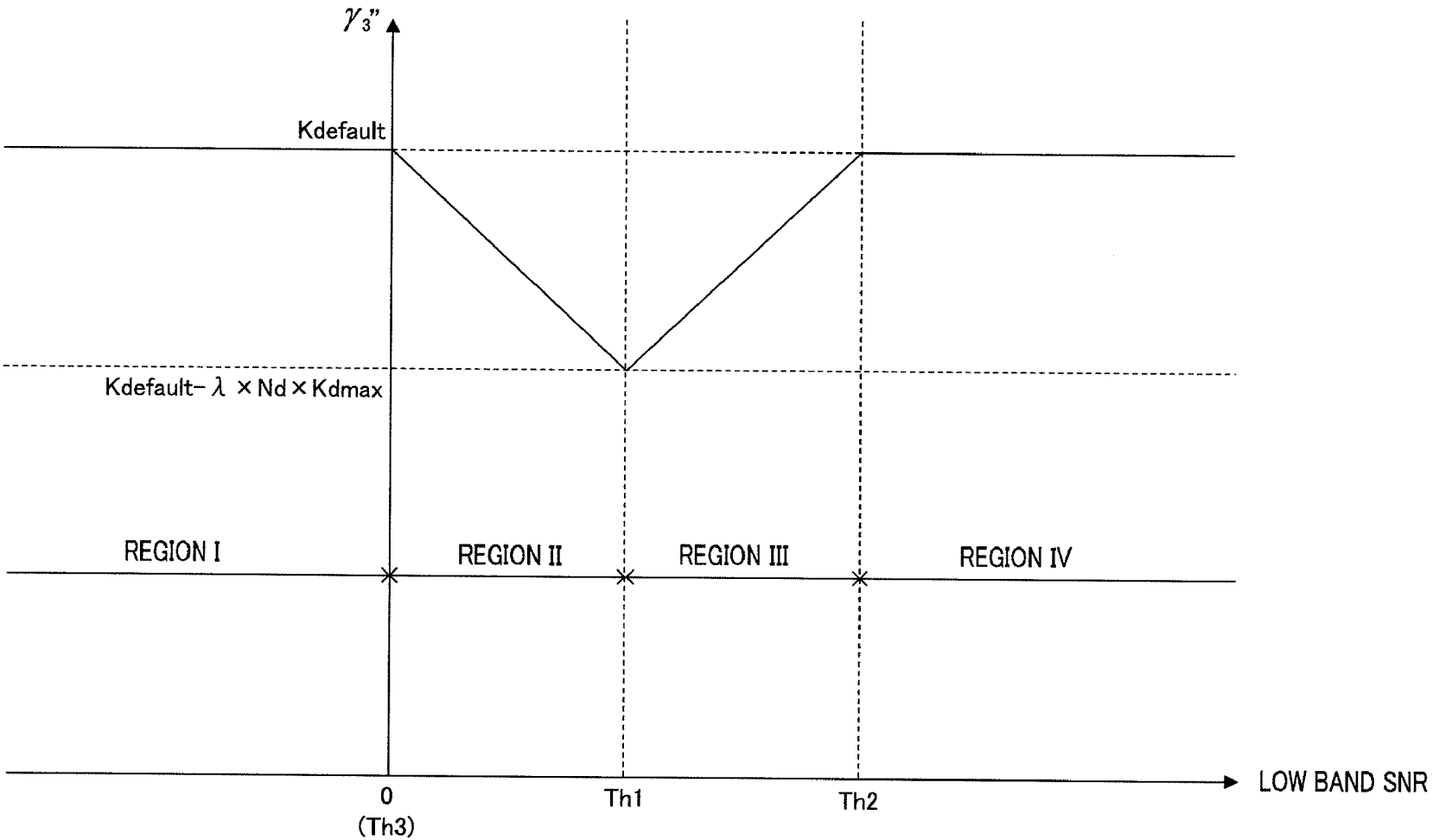
FIG. 22 illustrates a relationship between a tilt compensation coefficient and low band SNRs according to Embodiment 7 of the present invention.

The relationship between the tilt compensation coefficient $\gamma_3''$ calculated in compensation coefficient calculating section 753 and the low band SNR received as input from low band SNR calculating section 734, is as shown in FIG. 22. FIG. 22 is equivalent to a figure acquired by replacing Kmax in FIG. 14 with Kdefault and replacing Kmin in FIG. 14 with Kdefault−λ×Nd×Kdmax.

The reason for adjusting the amount of coefficient modification to be smaller when the low band and high band noise level ratio decreases in coefficient modification amount adjusting section 752, will be described below. That is, the low band and high band noise level ratio refers to information showing the spectral envelope of a background noise signal, and, when the low band and high band noise level ratio decreases, the spectral envelope of background noise approaches a flat, or convexes/concaves are present in the spectral envelope of background noise in a frequency band between the low band and the high band (i.e. middle band). When the spectral envelope of background noise is flat or when convexes/concaves are present in the spectral envelope of background noise only in the middle band, effect of noise shaping cannot be acquired if the slope of a tilt filter is increased or decreased. In this case, coefficient modification amount adjusting section 752 performs adjustment such that the amount of coefficient modification is small. By contrast, when the background noise level in the low band is sufficiently higher than the background noise level in the high band, the spectral envelope of a background noise signal approaches the frequency characteristic of the tilt compensation filter, and, by adaptively controlling the slope of the tilt compensation filter, it is possible to perform noise shaping to improve subjective quality. Therefore, in this case, coefficient modification amount adjusting section 752 performs adjustment such that the amount of coefficient modification is large.

As described above, according to the present embodiment, by adjusting the tilt compensation coefficient according to the SNR of an input speech signal and the low band and high band noise level ratio, it is possible to perform noise shaping associated with the spectral envelope of a background noise signal.

Further, according to the present embodiment, noise period detecting section 135 may use output information from energy level calculating section 731 and noise level updating section 732 to detect a noise period. Further, processing in noise period detecting section 135 is shared in a voice activity detector (VAD) and background noise suppressor, and, if embodiments of the present invention are applied to a coder having processing sections such as a VAD processing section and background noise suppression processing section, it is possible to utilize output information from these processing sections. Further, if a background noise suppression processing section is provided, the background noise suppression processing section is generally provided with an energy level calculating section and noise level updating section and, consequently, part of processing in energy level calculating section 731 and noise level updating section 732 and processing in the background noise suppression processing may be common.

Further, although an example case has been described above with the present embodiment where energy level calculating section 731 converts an input speech signal into a frequency domain signal to calculate the energy level in the low band and high band, if embodiments of the present invention are applied to a coder that can perform background noise suppression processing such as spectrum subtraction, it is possible to calculate the energy utilizing the DFT spectrum or FFT spectrum of the input speech signal and the DFT spectrum or FFT spectrum of an estimated noise signal (estimated background noise signal) acquired in the background noise suppression processing.

Further, energy level calculating section 731 according to the present embodiment may calculate the energy level by time domain signal processing using a high pass filter and low pass filter.

Further, when the estimated background noise signal level En is less than a predetermined level, compensation coefficient calculating section 753 may perform additional processing such as following equation 34 and further adjust modification amount D2 after adjustment.

$$D2'=\lambda'\times En\times D2(0\leqq(\lambda'\times En)\leqq 1) \quad \text{(Equation 34)}$$

In equation 34, λ' is the adjustment coefficient by which the background noise signal level En is multiplied, and uses, for example, 0.1. In a case where λ is 0.1, the background noise level En is greater than 10 dB and λ'×En is greater than 1, compensation coefficient calculating section 753 clips λ'×En to "1" as shown in λ×Nd=1. Further, similarly, in the case where En is equal to or less than 0, compensation coefficient calculating section 753 clips λ×En to "0" as shown in λ×En=0. Further, En may be the noise signal level in the whole band. In other words, when the background noise level is a given level such as 10 or less dB, this processing refers to processing for making the amount of modification D2 small in proportion to the background noise level. This is performed to cope with problems where effect of noise shaping utilizing the spectrum characteristic of background noise cannot be provided and where an error of an estimated background noise level is likely to increase (there are cases where there actually is not background noise yet where a background noise signal may be estimated from, for example, the sound of intake of breath and unvoiced sound at an extremely low level).

Embodiments of the present invention have been described above.

Further, in drawings, a signal illustrated as only passing within a block, needs not pass the block every time. Further, in the drawings, even if a branch of the signal is likely to be performed inside the block, the signal needs not be branched in the block every time, and the branch of the signal may be performed outside the block.

Further, LSF and ISF can be referred to as LSP (Line Spectrum Pairs) and ISP (Immittance Spectrum Pairs), respectively.

The speech encoding apparatus according to the present invention can be mounted on a communication terminal apparatus and base station apparatus in a mobile communication system, so that it is possible to provide a communication terminal apparatus, base station apparatus and mobile communication system having the same operational effect as above.

Although a case has been described with the above embodiments as an example where the present invention is implemented with hardware, the present invention can be implemented with software. For example, by describing the speech encoding method according to the present invention in a programming language, storing this program in a memory and making the information processing section execute this program, it is possible to implement the same function as the speech encoding apparatus of the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2006-251532, filed on Sep. 15, 2006, Japanese Patent Application No. 2007-051486, filed on Mar. 1, 2007 and Japanese Patent Application No. 2007-216246, filed on Aug. 22, 2007, including the specifications, drawings and abstracts, are incorporated herein by reference in their entirety.

Industrial Applicability

The speech encoding apparatus and speech encoding method according to the present invention are applicable for, for example, performing shaping of quantization noise in speech encoding.

The invention claimed is:

1. A speech encoding apparatus comprising:

a linear prediction analyzing section that performs a linear prediction analysis with respect to a speech signal to generate a linear prediction coefficient;

a quantizing section that quantizes the linear prediction coefficient;

a perceptual weighting section that performs perceptual weighting filtering with respect to an input speech signal to generate a perceptual weighted speech signal using a transfer function including a tilt compensation coefficient for adjusting a spectral slope of a quantization noise;

a tilt compensation coefficient control section that controls the tilt compensation coefficient using a signal to noise ratio of the speech signal in a first frequency band; and an excitation search section that performs an excitation search of an adaptive codebook and fixed codebook to generate an excitation signal using the perceptual weighted speech signal.

2. The speech encoding apparatus according to claim 1, wherein the tilt compensation coefficient control section controls the tilt compensation coefficient using the signal to noise ratio of a first signal in the first frequency band of the speech signal and a signal to noise ratio of a second signal in a second frequency band higher than the first frequency band of the speech signal.

3. The speech encoding apparatus according to claim 2, wherein the tilt compensation coefficient control section further comprises:

an extracting section that extracts from the speech signal the first signal in the first frequency band and the second signal in the second frequency band higher than the first frequency band;

an energy calculating section that calculates an energy of the first signal and an energy of the second signal;

a noise period energy calculating section that calculates an energy of a noise period in the first signal and an energy of a noise period in the second signal;

a signal to noise ratio calculating section that calculates a signal to noise ratio of the first signal and a signal to noise ratio of the second signal; and a tilt compensation coefficient calculating section that acquires the tilt compensation coefficient by multiplying a difference between the signal to noise ratio of the first signal and the signal to noise ratio of the second signal and a first constant, and further adding a second constant to a multiplication result.

4. The speech encoding apparatus according to claim 3, wherein the tilt compensation coefficient comprises a tilt compensation coefficient for shaping a low band component of the quantization noise higher when the signal to noise ratio of the second signal becomes higher than the signal to noise ratio of the first signal, and shaping a high band component of the quantization noise higher when the signal to noise ratio of the first signal becomes higher than the signal to noise ratio of the second signal.

5. The speech encoding apparatus according to claim 3, wherein the tilt compensation coefficient control section further comprises:

a lower limit value calculating section that calculates a lower limit value of the tilt compensation coefficient by adding the energy of the noise period in the first signal and the energy of the noise period in the second signal, and further multiplying an addition result by a third constant; and a limiting section that limits the tilt compensation coefficient to a range between the lower limit value and a predetermined upper limit value.

6. The speech encoding apparatus according to claim 2, wherein the tilt compensation coefficient control section further comprises a noise period detecting section that detects as a noise period one of a period in which an energy calculated using the speech signal is less than a first threshold, and a period in which a parameter equivalent to a reciprocal of a linear prediction gain acquired by the linear prediction analysis with respect to the speech signal is less than a second threshold and in which a pitch prediction gain acquired by pitch analysis with respect to the speech signal is less than a third threshold.

7. The speech encoding apparatus according to claim 6, wherein the noise period detecting section detects the noise period of the speech signal using an energy acquired by adding an energy of the first signal and an energy of the second signal, a parameter relating to the linear prediction gain acquired in a process of the linear prediction analysis in the linear prediction analyzing section, and the pitch prediction gain acquired in a process of the excitation search.

8. The speech encoding apparatus according to claim 7, further comprising:

a first counter that counts the number of frames determined consecutively as the noise period; and a second counter that counts the number of frames determined consecutively as a speech period, wherein, in the detected noise period, the noise period detecting section detects a period corresponding to one of a period in which a value on the first counter is less than a fourth threshold, a period in which a value on the second counter is equal to or greater than a fifth counter, and a period in which the signal to noise ratio of the first signal and the signal to noise ratio of the second signal are both less than a sixth threshold.

9. The speech encoding apparatus according to claim 1, wherein the tilt compensation coefficient control section further comprises:

an extracting section that extract a first signal in a first frequency band from the speech signal;

an energy calculating section that calculates an energy of the first signal;

a noise period energy calculating section that calculates an energy of a noise period in the first signal; and a tilt compensation coefficient calculating section that, if a signal to noise ratio of the first signal is equal to or greater than a first threshold, makes a value of the tilt compensation coefficient larger when the signal to noise ratio of the first signal increases, and that, if the signal to noise ratio of the first signal is less than the first threshold, makes the value of the tilt compensation coefficient larger when the signal to noise ratio of the first signal decreases.

10. The speech encoding apparatus according to claim 9, wherein the tilt compensation coefficient calculating section limits the value of the tilt compensation coefficient within a predetermined range, and, when the signal to noise ratio of the first signal is equal to or less than a second threshold or equal to or greater than a third threshold, makes the value of the tilt compensation coefficient a maximum value in the predetermined range.

11. The speech encoding apparatus according to claim 1, wherein the tilt compensation coefficient control section further comprises:

an energy calculating section that calculates an energy of the speech signal in the first frequency band and an energy of the speech signal in a second frequency band higher than the first frequency band;

a noise period energy calculating section that calculates an energy of a noise period in the first frequency band and the second frequency band of the speech signal;

a signal to noise ratio calculating section that calculates a signal to noise ratio in the first frequency band of the speech signal; and a tilt compensation coefficient calculating section that calculates the tilt compensation coefficient based on the signal to noise ratio in the first frequency band of the speech signal and an energy ratio of the noise period in the first frequency band and the noise period in the second frequency band in the speech signal.

12. A speech encoding apparatus comprising:

a linear prediction analyzing section that performs a linear prediction analysis with respect to a speech signal to generate a linear prediction coefficient;

a quantizing section that quantizes the linear prediction coefficient;

a perceptual weighting section that performs perceptual weighting filtering with respect to an input speech signal to generate a perceptual weighted speech signal using a transfer function including a tilt compensation coefficient for adjusting a spectral slope of a quantization noise; and a weight coefficient control section that controls a weight coefficient forming a linear prediction inverse filter that performs perceptual weighting filtering with respect to an input speech signal in the perceptual weighting section, using the signal to noise ratio of the speech signal, wherein the weight coefficient control section comprises:

an energy calculating section that calculates an energy of the speech signal;

a noise period energy calculating section that calculates an energy of a noise period in the speech signal; and a calculating section that calculates an adjustment coefficient and calculates the weight coefficient by multiplying a linear prediction coefficient of a noise period in the speech signal by an adjustment coefficient, the adjustment coefficient increasing when the signal to noise ratio of the speech signal is equal to or greater than a first threshold and the signal to noise ratio of the speech signal is higher, and decreasing when the signal to noise ratio of the speech signal is less than the first threshold and the signal to noise ratio of the speech signal is lower.

13. The speech encoding apparatus according to claim 12, wherein the calculating section makes the adjustment coefficient zero when the signal to noise ratio of the speech signal is equal to or less than a second threshold or equal to or greater than a third threshold.

14. A speech encoding method comprising the steps of:

performing a linear prediction analysis with respect to a speech signal to generate a linear prediction coefficient;

quantizing the linear prediction coefficient;

performing perceptual weighting filtering with respect to an input speech signal to generate a perceptual weighted speech signal using a transfer function including a tilt compensation coefficient for adjusting a spectral slope of a quantization noise;

controlling the tilt compensation coefficient using a signal to noise ratio in a first frequency band of the speech signal; and performing an excitation search of an adaptive codebook and fixed codebook to generate an excitation signal using the perceptual weighted speech signal.

15. The speech encoding method according to claim 14, wherein the steps of controlling the tilt compensation coefficient comprises controlling the tilt compensation coefficient using the signal to noise ratio of a first signal in the first frequency band of the speech signal and a signal to noise ratio of a second signal in a second frequency band higher than the first frequency band of the speech signal.

* * * * *